US008215632B2

(12) United States Patent
Stiehler et al.

(10) Patent No.: US 8,215,632 B2
(45) Date of Patent: Jul. 10, 2012

(54) PICK ROLLER RETRACTION METHOD IN A CARRIAGE PRINTER

(75) Inventors: Wayne E. Stiehler, Spencerport, NY (US); Sivanandam T. Sathiyamoorthy, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 141 days.

(21) Appl. No.: 12/871,106

(22) Filed: Aug. 30, 2010

(65) Prior Publication Data

US 2012/0049433 A1 Mar. 1, 2012

(51) Int. Cl.
*B65H 3/06* (2006.01)
*B41J 2/01* (2006.01)

(52) U.S. Cl. ..... 271/117; 271/118; 347/104

(58) Field of Classification Search ..... 271/117, 271/118; 347/104, 101; 346/134; 400/578; 399/361

See application file for complete search history.

(56) References Cited

U.S. PATENT DOCUMENTS

| | | | | |
|---|---|---|---|---|
| 4,556,209 | A | 12/1985 | Tsubo | |
| 4,674,736 | A | 6/1987 | Tsubo | |
| 5,615,874 | A | 4/1997 | Parthasarathy et al. | |
| 5,711,519 | A | 1/1998 | Bortolotti | |
| 5,857,671 | A | 1/1999 | Kato et al. | |
| 5,895,040 | A | 4/1999 | Oleksa et al. | |
| 5,899,450 | A | 5/1999 | Gettelfinger et al. | |
| 5,971,390 | A | 10/1999 | Caspar et al. | |
| 6,158,733 | A | 12/2000 | Muraki | |
| 6,217,017 | B1 | 4/2001 | Yamazaki | |
| 6,279,897 | B1 | 8/2001 | Richards | |
| 6,392,763 | B1 | 5/2002 | Nishinohara et al. | |
| 6,536,757 | B2 | 3/2003 | Chang | |
| 6,547,235 | B2 | 4/2003 | Higaki | |
| 6,626,595 | B2 * | 9/2003 | Kabamoto | 400/624 |
| 6,716,254 | B2 | 4/2004 | Takeuchi | |
| 6,893,013 | B2 | 5/2005 | Spitz et al. | |
| 7,000,916 | B2 | 2/2006 | Asada et al. | |
| 7,029,004 | B2 | 4/2006 | Asada et al. | |
| 7,036,814 | B2 | 5/2006 | Oh et al. | |
| 7,063,417 | B2 * | 6/2006 | Iwakura et al. | 347/104 |
| 7,066,461 | B2 | 6/2006 | Asada | |
| 7,100,914 | B2 | 9/2006 | Ramos | |
| 7,108,257 | B2 | 9/2006 | Shiohara et al. | |
| 7,128,317 | B2 | 10/2006 | Johnson et al. | |
| 7,131,644 | B2 | 11/2006 | Williamson et al. | |
| 7,207,736 | B2 * | 4/2007 | Jang | 400/630 |
| 7,222,955 | B2 * | 5/2007 | Ohashi et al. | 347/104 |
| 7,350,902 | B2 | 4/2008 | Dietl et al. | |
| 7,594,652 | B2 * | 9/2009 | Schalk et al. | 271/117 |
| 2009/0174748 | A1 | 7/2009 | Balcan | |
| 2012/0050430 | A1 * | 3/2012 | Stiehler et al. | 347/101 |
| 2012/0050437 | A1 * | 3/2012 | Stiehler | 347/104 |

* cited by examiner

*Primary Examiner* — Kaitlin Joerger
(74) *Attorney, Agent, or Firm* — Eugene I. Shkurko

(57) ABSTRACT

A method of automatically pivoting a pick arm assembly away from a media support in a printer by providing a printhead carriage with a sloped feature and providing a linking assembly coupled to the pick arm assembly with a ramped feature wherein pivoting the pick arm assembly away from the media support occurs when the printhead carriage travels along the carriage scan path.

17 Claims, 21 Drawing Sheets

PICK ROLLER RETRACTION METHOD IN A CARRIAGE PRINTER

CROSS REFERENCE TO RELATED APPLICATIONS

Reference is made to commonly assigned, co-pending U.S. patent applications:

Ser. No. 12/871,078 by Wayne E. Stiehler and Sathiyamoorthy T. Sivanandam filed of even date herewith entitled "Media Stopper For A Printing System";

Ser. No. 12/871,067 by Wayne E. Stiehler and Sathiyamoorthy T. Sivanandam filed of even date herewith entitled "Pick Roller Retraction In A Carriage Printer";

Ser. No. 12/871,090 by Wayne E. Stiehler and Sathiyamoorthy T. Sivanandam filed of even date herewith entitled "Media Stopper Method For A Printing System"; and Ser. No. 12/871,124 by Wayne E. Stiehler filed of even date herewith entitled "Media Separator For A Printing System", the disclosures of which are incorporated herein by reference in their entireties.

FIELD OF THE INVENTION

The present invention generally relates to paper handling in a carriage printer, and more particularly to the retraction of the pick roller assembly so that recording media can be more easily loaded.

BACKGROUND OF THE INVENTION

In a carriage printer, such as an inkjet carriage printer, a printhead is mounted in a carriage that is moved back and forth across the region of printing. To print an image on a sheet of paper or other print medium, the medium is advanced a given nominal distance along a media advance direction and then stopped. While the medium is stopped and supported on a platen, the printhead carriage is moved in a direction that is substantially perpendicular to the media advance direction as marks are controllably made by marking elements on the medium—for example by ejecting drops from an inkjet printhead. After the carriage has printed a swath of the image while traversing the print medium, the medium is advanced, the carriage direction of motion is reversed, and the image is formed swath by swath.

FIG. 1 shows a schematic side view of a prior art carriage printer having a so-called L-shaped paper path. A variety of rollers are used to advance the medium through the printer. In this example, a pick roller 350 moves the first piece or sheet 371 of a stack 370 of paper (also generically called recording medium herein) at media input support 320 from paper load entry direction 301 toward media retention plate 340. Media retention plate 340 is disposed along media advance direction 304 and is at an angle $\alpha$ with respect to media input support 320. Angle $\alpha$ is typically greater than 60 degrees, so that when seen from the side view of FIG. 1, media input support 320 and media retention plate 340 look approximately like a letter L. The piece 371 of recording medium is then moved by feed roller 312 and idler roller(s) 323 to advance through the print region 303, and from there to a discharge roller 324 and star wheel(s) 325. Carriage 200 moves a printhead die 251 along a carriage scan direction that is into the plane of FIG. 1 and ink drops 270 are controllably ejected to print an image as the carriage is moved. Supporting the piece 371 of recording medium at print region 303 is a platen 390. In order to facilitate the printing of borderless prints where the image is printed to the edges of the recording medium, platen 390 can have support ribs 394 in between which is disposed an absorbent medium 392 to catch ink drops that are oversprayed beyond the edges of the recording medium.

In order to provide sufficient frictional force to advance top piece 371 of recording medium from the stack 370 during the pick operation, pick roller 350 is provided with a high friction surface and is typically biased against the stack 370 with a biasing force. The biasing force can be provided, for example by a spring, or by the weight of the pick roller assembly, or by the motor that drives the rotation of the pick roller. Although the biasing force facilitates the pick operation, the biasing force must be overcome in order to load additional pieces of recording medium at the media input support 320. If the recording medium is sufficiently stiff, or if there is a sufficient number of sheets of recording medium to provide overall stiffness of the stack being loaded, the recording medium itself can push the pick roller away while the recording medium is being loaded. However, when only a few sheets of low stiffness are being loaded, the biasing force on the pick roller can result in wrinkled or damaged recording medium, which can lead to paper jams in some instances. Since a user may wish to load only a few pieces (or even a single sheet) of low stiffness recording medium, a way of reliable paper loading must be provided for such instances.

In a paper feeding apparatus described in U.S. Pat. No. 6,547,235 the "draw-out roller" (similar in function to a pick roller) can be moved away from the stack or media or toward the stack of media by using the same motor that is also used to cause the pick roller to rotate. However, that paper feeding apparatus uses two motors and two one-way clutches, requiring additional space and cost.

What is needed is simple, low cost and compact way of overcoming the pick roller's biasing force so that even one or two sheets of low stiffness recording medium can be reliably loaded into the printer without causing wrinkling or other damage to the recording medium.

SUMMARY OF THE INVENTION

A preferred embodiment of the present invention includes a method of operating a media feeder in an inkjet printing system. The method comprises providing a media input support, providing a pivotable pick arm assembly including a pick roller that is biased to pivot toward the media input support, providing a rotatable arm including a member that is linked to the pivotable pick arm assembly and a ramped feature, providing a carriage that is movable along a carriage scan direction, the carriage including a holder for an inkjet printhead and a sloped feature that is in line with the ramped feature of the rotatable arm. A next step includes moving the carriage along the carriage scan direction until the sloped feature of the carriage engages the ramped feature of the rotatable arm, thereby rotating the rotatable arm to pull the pivotable pick arm assembly in a direction away from the media input support. The step of rotating the rotatable arm to pull the pivotable pick arm assembly in a direction away from the media input support can include providing a gap between the pick roller and the media input support and loading paper at the media input support after the gap is provided. The method can also include biasing the pick arm assembly to move toward the media input support when the sloped feature of the carriage is not engaged with the ramped feature of the rotatable arm. Further preferred alternatives include providing a media advance motor, providing a feed roller, providing a feed roller gear that is coaxially mounted on the feed roller, providing a pick clutch assembly that includes a first gear disposed proximate the feed roller gear, a second gear engaged with the first gear, and providing a gear train for transmitting power to rotate the pick roller. The method can also include moving the carriage along the carriage scan direction until the sloped feature of the carriage is disengaged from the ramped feature of the rotatable arm, thereby allowing the pivotable pick arm assembly to move in a direction toward the media input support. Further steps can include rotating the media advance motor in a reverse direction to rotate the feed roller and feed roller gear in a reverse direction, engaging the pick clutch assembly with the gear train to provide power to the pick roller, and rotating the pick roller in a direction to advance a piece of media from the media input support toward the feed roller, detecting a lead edge of the piece of media, rotating the media advance motor in a forward direction after the lead edge of the piece of media is detected to have reached the feed roller, and disengaging the pick clutch assembly from the gear train. This last option can be modified to include disengaging the pick clutch assembly from the gear train when the sloped feature of the carriage engages the ramped feature of the rotatable arm.

Another preferred embodiment of the present invention includes a method of operating a printer including providing a media input support, providing a pivotable pick arm assembly including a pick roller that is biased to pivot toward the media input support, providing a rotatable arm that includes a member that is linked to the pivotable pick arm assembly and a ramped feature. Then, providing a carriage that is movable along a carriage scan direction, the carriage includes an inkjet printhead and a sloped feature that is in line along the carriage scan direction with the ramped feature of the rotatable arm. Further steps include providing a maintenance station proximate the rotatable arm, the maintenance station including a cap and a maintenance station activator arm, providing a media advance motor, providing a feed roller, providing a feed roller gear that is coaxially mounted on the feed roller, providing a pick clutch assembly including a first gear disposed proximate the feed roller gear, and a second gear engaged with the first gear, providing a gear train for transmitting power to rotate the pick roller, and then moving the carriage along the carriage scan direction until the sloped feature of the carriage engages the ramped feature of the rotatable arm, thereby disengaging the pick clutch assembly. Further steps include moving the carriage along the carriage scan direction until the printhead is over the maintenance station and the sloped feature of the carriage engages the maintenance station activator arm, and rotating the media advance motor in reverse to move the cap into a printhead capping position.

These, and other, aspects and objects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. For example, the summary descriptions above are not meant to describe individual separate embodiments whose elements are not interchangeable. In fact, many of the elements described as related to a particular embodiment can be used together with, and possibly interchanged with, elements of other described embodiments. Many changes and modifications may be made within the scope of the present invention without departing from the spirit thereof, and the invention includes all such modifications. The figures below are intended to be drawn neither to any precise scale with respect to relative size, angular relationship, or relative position nor to any combinational relationship with respect to interchangeability, substitution, or representation of an actual implementation.

These and other features and advantages of the present invention will become apparent to those skilled in the art upon a reading of the following detailed description when taken in conjunction with the drawings wherein there is shown and described an illustrative preferred embodiment of the invention.

DETAILED DESCRIPTION OF THE INVENTION

Figure 2:
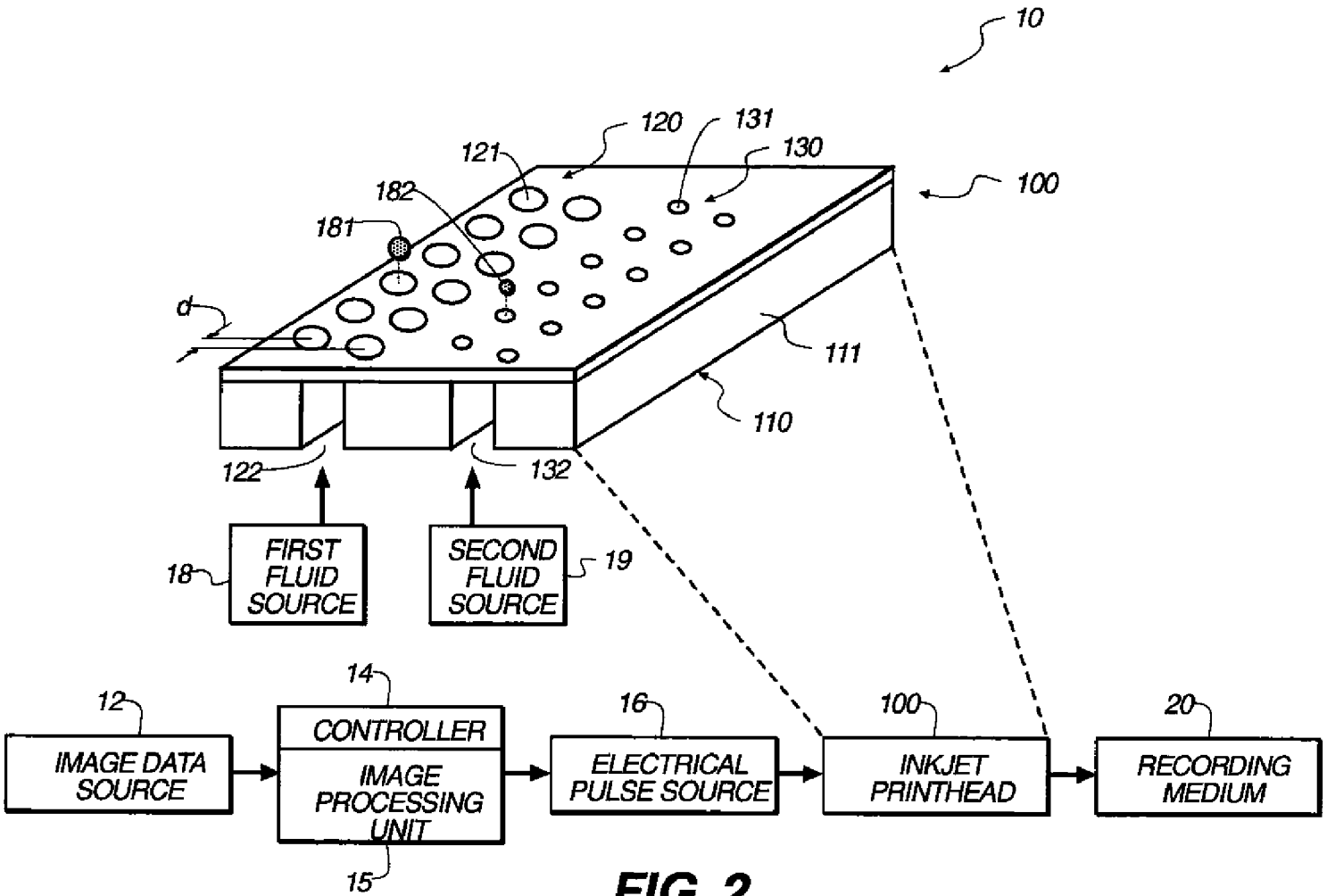
FIG. 2 schematically shows an inkjet printer system.

Referring to FIG. 2, a schematic representation of an inkjet printer system 10 is shown, for its usefulness with the present invention and is fully described in U.S. Pat. No. 7,350,902 which is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 2, there are two nozzle arrays 120 and 130 that are each disposed along a nozzle array direction 254. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. d=1/1200 inch in FIG. 2). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 2 as openings through printhead die substrate 111. One or more inkjet printhead die 110 will be included in inkjet printhead 100, but for greater clarity only one inkjet printhead die 110 is shown in FIG. 2. The printhead die are arranged on a mounting support member as discussed below relative to FIG. 3. In FIG. 2, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132, respectively. Also, in some embodiments, fewer than two or more than two nozzle arrays can be included on inkjet printhead die 110. In some embodiments, all nozzles on inkjet printhead die 110 can be the same size, rather than having multiple sized nozzles on inkjet printhead die 110.

The drop forming mechanisms associated with the nozzles are not shown in FIG. 2. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 2, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20 (also sometimes called paper, print medium or medium herein).

Figure 3:
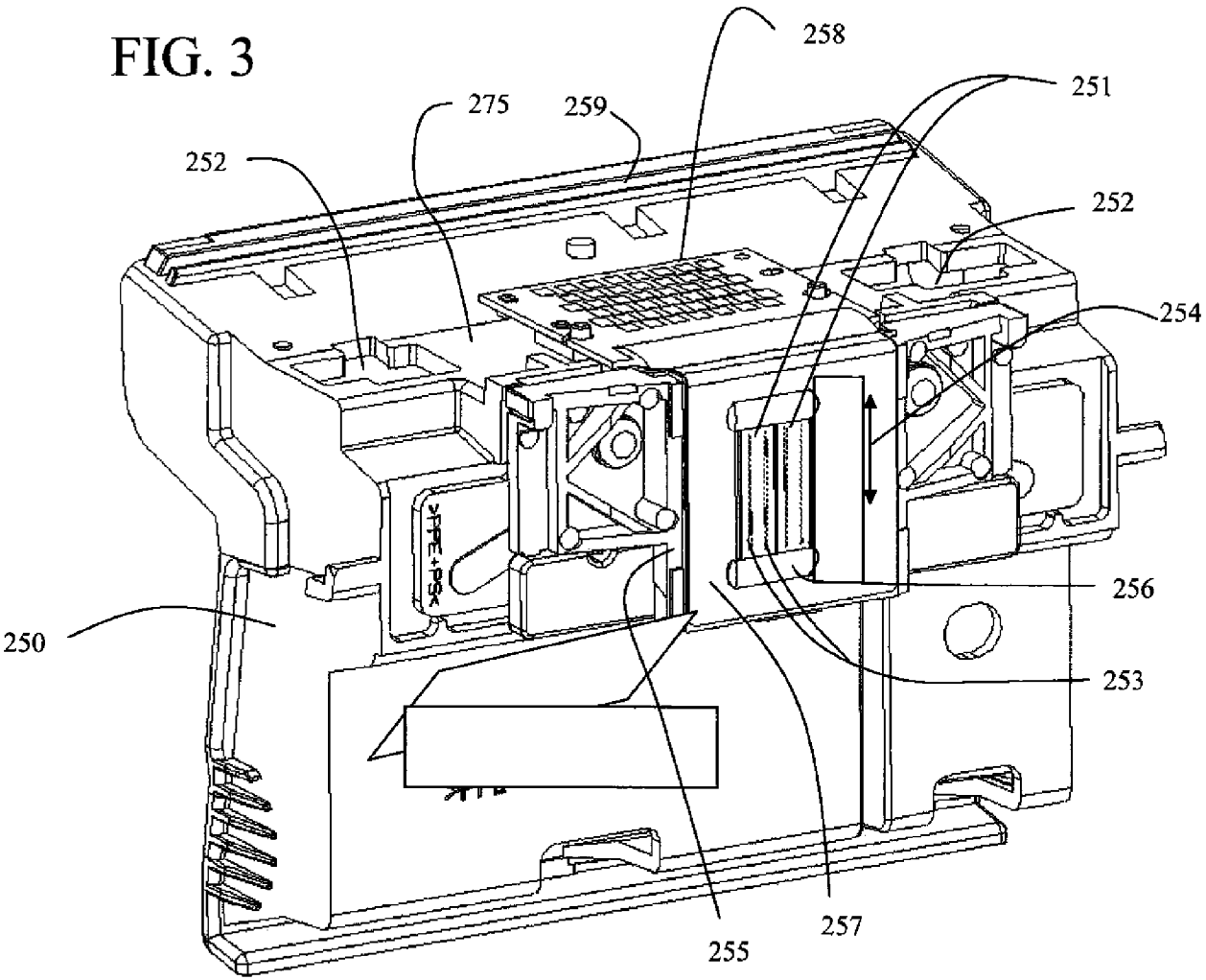
FIG. 3 is a perspective view of a printhead.

FIG. 3 shows a perspective view of a portion of a printhead 250, which is an example of an inkjet printhead 100. Printhead 250 includes two printhead die 251 (similar to inkjet printhead die 110 of FIG. 2) that are affixed to a common mounting support member 255. Each printhead die 251 contains two nozzle arrays 253, so that printhead 250 contains four nozzle arrays 253 altogether. The four nozzle arrays 253 in this example can each be connected to separate ink sources. Each of the four nozzle arrays 253 is disposed along nozzle array direction 254, and the length of each nozzle array along nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead 250 across the recording medium 20. Following the printing of a swath, the recording medium 20 is advanced along a media advance direction that is substantially parallel to nozzle array direction 254.

Also shown in FIG. 3 is a flex circuit 257 to which the printhead die 251 are electrically interconnected, for example, by wire bonding or TAB bonding. The interconnections are covered by an encapsulant 256 to protect them. Flex circuit 257 bends around the side of printhead 250 and connects to connector board 258. When printhead 250 is mounted into the carriage 200 (see FIG. 5), connector board 258 is electrically connected to a connector 244 on the carriage 200, so that electrical signals can be transmitted to the printhead die 251.

Figure 4:
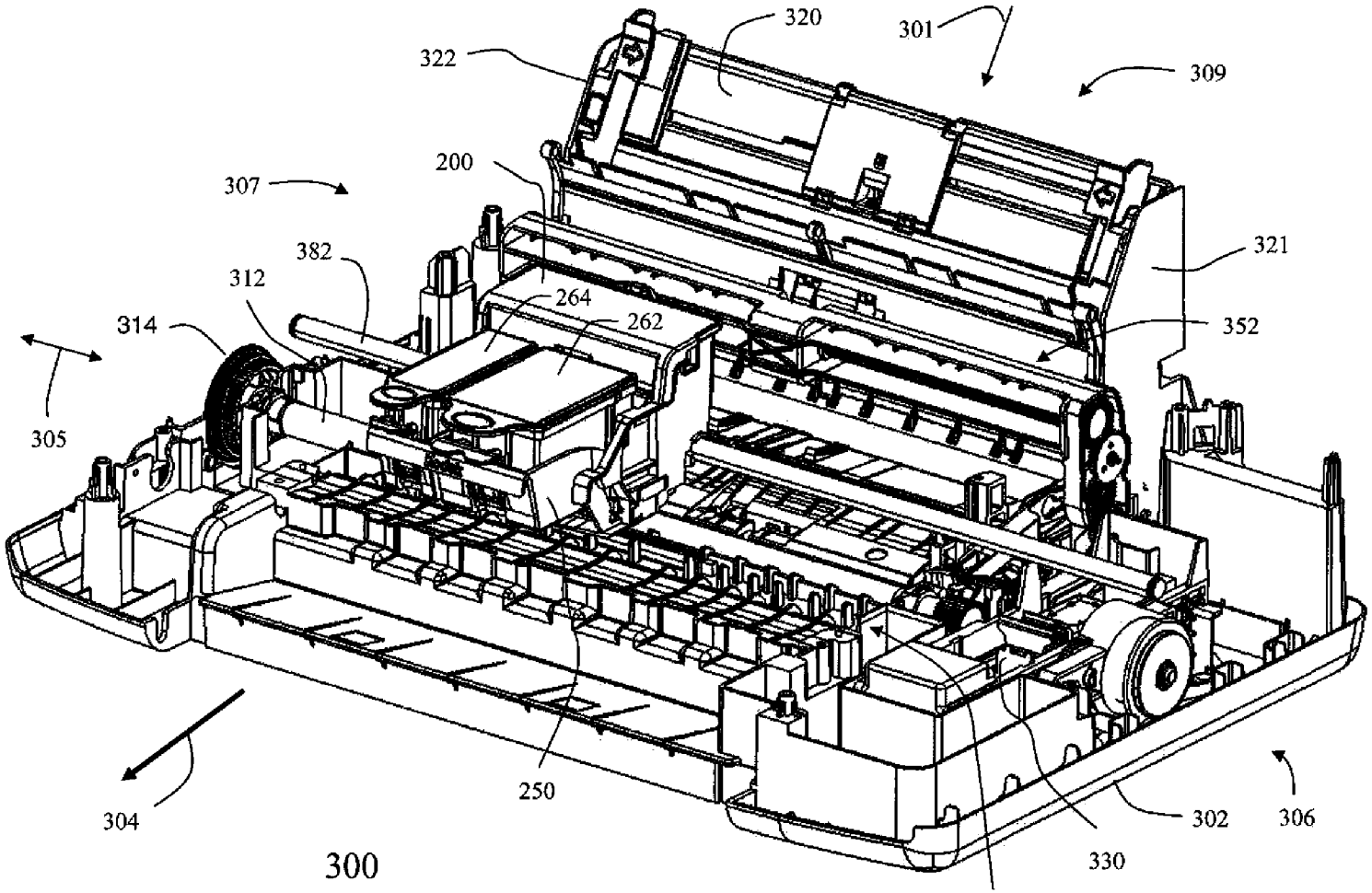
FIG. 4 is a perspective view of the printer of the present invention.

FIG. 4 shows a portion of a desktop carriage printer. Some of the parts of the printer have been hidden in the view shown in FIG. 4 so that other parts can be more clearly seen. Printer chassis 300 includes a horizontal base 302. Carriage 200 is moved back and forth in carriage scan direction 305, between the right side 306 and the left side 307 of printer chassis 300, while drops are ejected from printhead die 251 (not shown in FIG. 4) on printhead 250 that is mounted on carriage 200. This back and forth motion defines a carriage scan path having a right side terminus and a left side terminus. A carriage motor (not shown) moves carriage 200 along carriage guide rail 382.

Printhead 250 is mounted in carriage 200, and multi-chamber ink supply 262 and single-chamber ink supply 264 are mounted in the printhead 250. The mounting orientation of printhead 250 is rotated relative to the view in FIG. 3, so that the printhead die 251 are located at the bottom side of printhead 250, the droplets of ink being ejected downward in the view of FIG. 4. Multi-chamber ink supply 262, for example, contains three ink sources: e.g. cyan, magenta, and yellow ink; while single-chamber ink supply 264 contains black ink. Toward the right side 306 of the printer chassis 300, in the example of FIG. 4, is the maintenance station 330.

Figure 1:
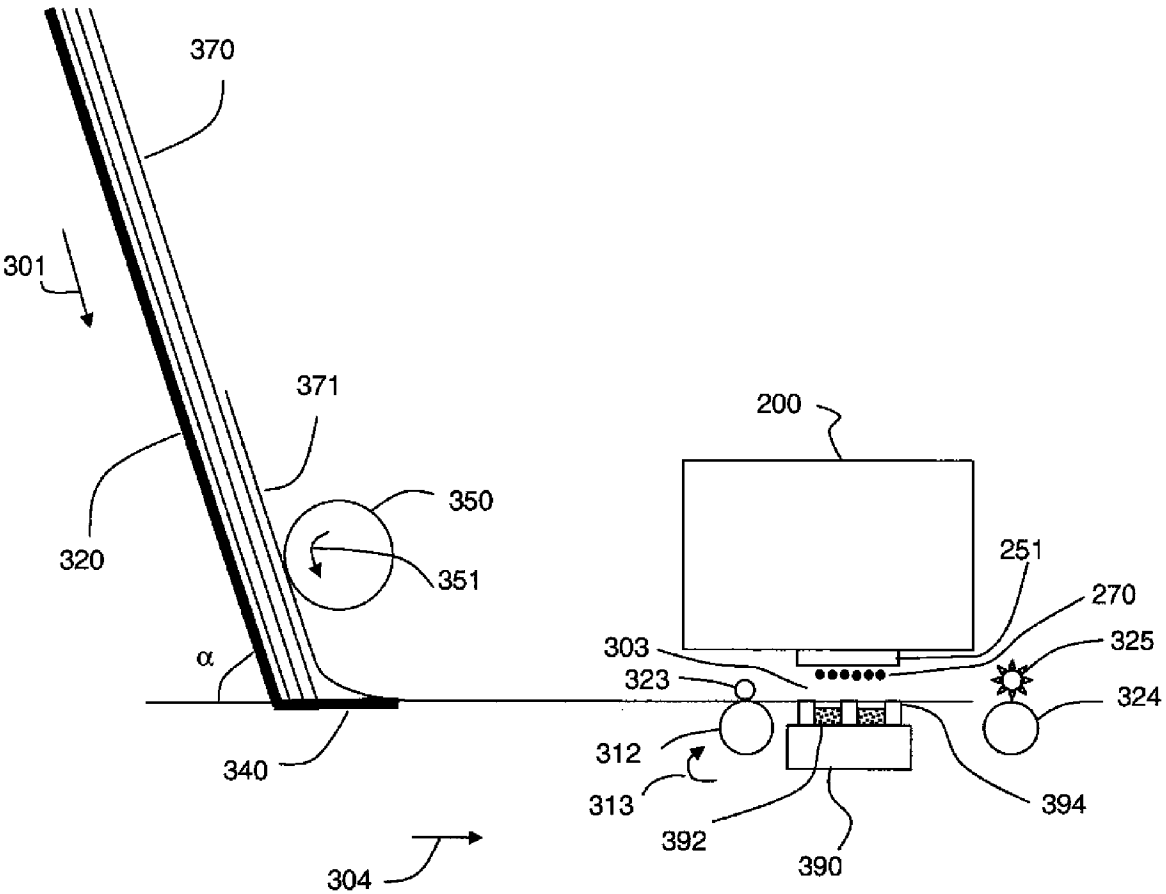
FIG. 1 PRIOR ART
FIG. 1 is a schematic side view of a prior art printer having an L-shaped paper path.
Figure 9:
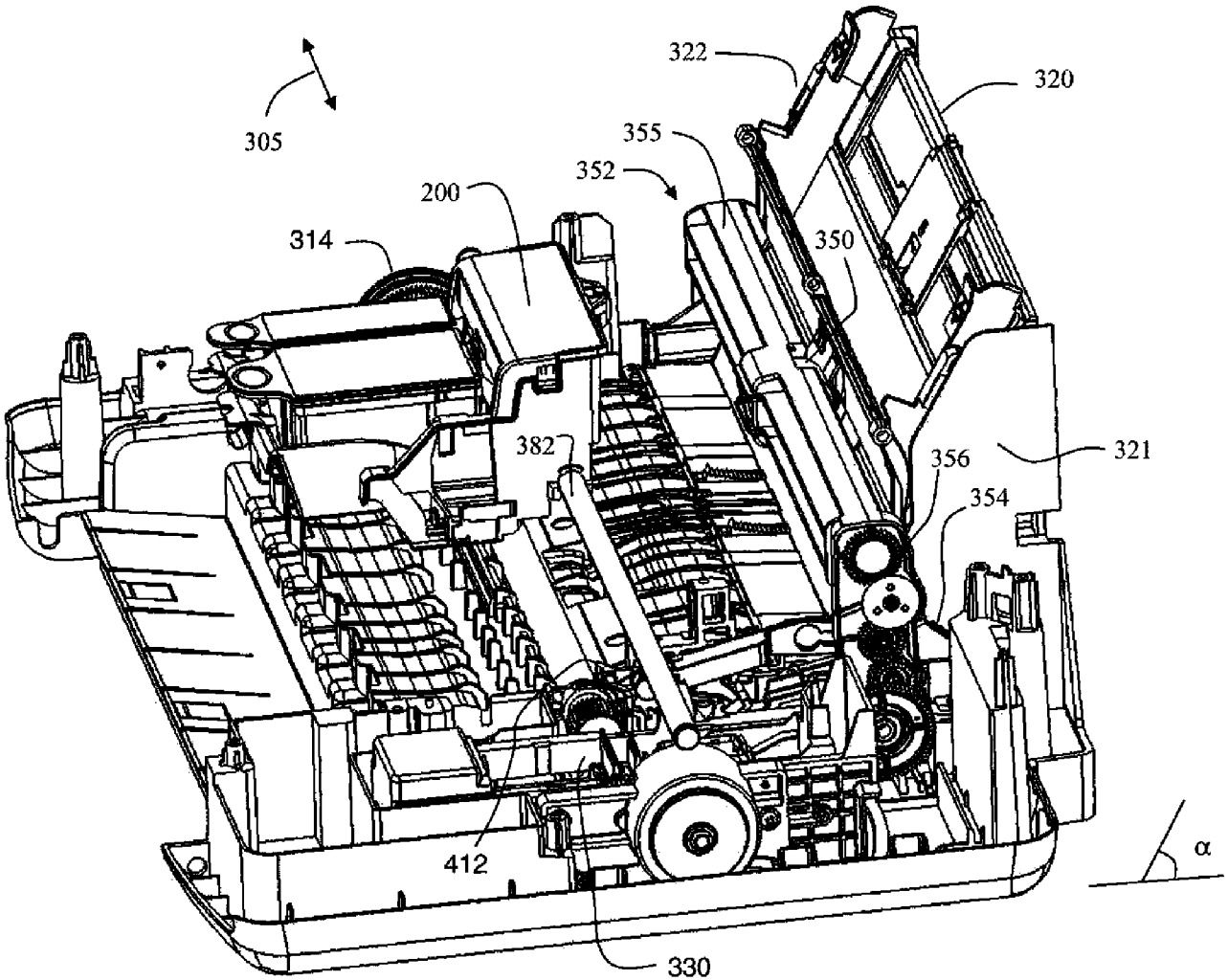
FIG. 9 is a side perspective view of a portion of an inkjet printing system with the pick arm assembly biased to pivot toward the media input support according to a preferred embodiment of the present invention.

In the L-shaped paper path shown in FIGS. 1, 4 and 9, the recording medium would be loaded along paper load entry direction 301 nearly vertically at an angle $\alpha$ of 60 degrees or more relative to horizontal base 302 (or relative to media retention plate 340) against media input support 320 at the rear 309 of the printer chassis. Media input support 320 includes a first side 321 and a second side 322. Several rollers are used to advance the recording medium through the printer. A pick roller 350 on pick arm assembly 352 is rotated in rotation direction 351 to move the first piece or sheet 371 of a stack 370 of paper or other recording medium in media input support 320 from paper load entry direction 301 to the media advance direction 304. The paper is then moved by feed roller 312 (as it is rotated in forward rotation direction 313) and idler roller(s) 323 to advance toward the print region 303 (disposed along carriage scan direction 305). Because the pick roller 350 contacts a top side of the piece 371 of recording medium and the feed roller 312 contacts the opposite side, the rotation direction 351 of pick roller 350 is opposite the forward rotation direction 313 of feed roller 312 in order to advance piece 371 of recording medium through the printer. Feed roller 312 is driven directly by a paper advance motor (not shown) that is connected by belt or gear engagement, for example at drive gear 314. After the image is printed at print region 303, the piece 371 of recording medium is further advanced to a discharge roller 324 and star wheel(s) 325.

Figure 5:
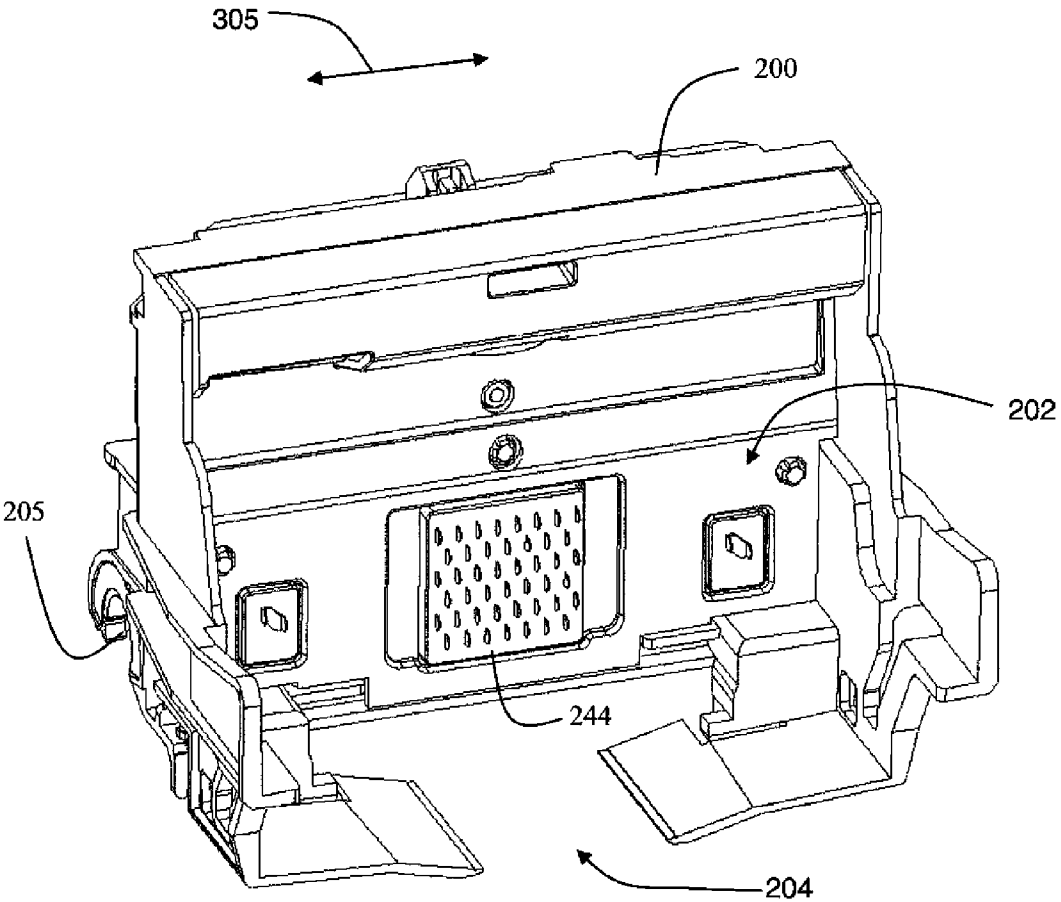
FIG. 5 is a perspective view of a carriage of the printer of the present invention.
Figure 7:
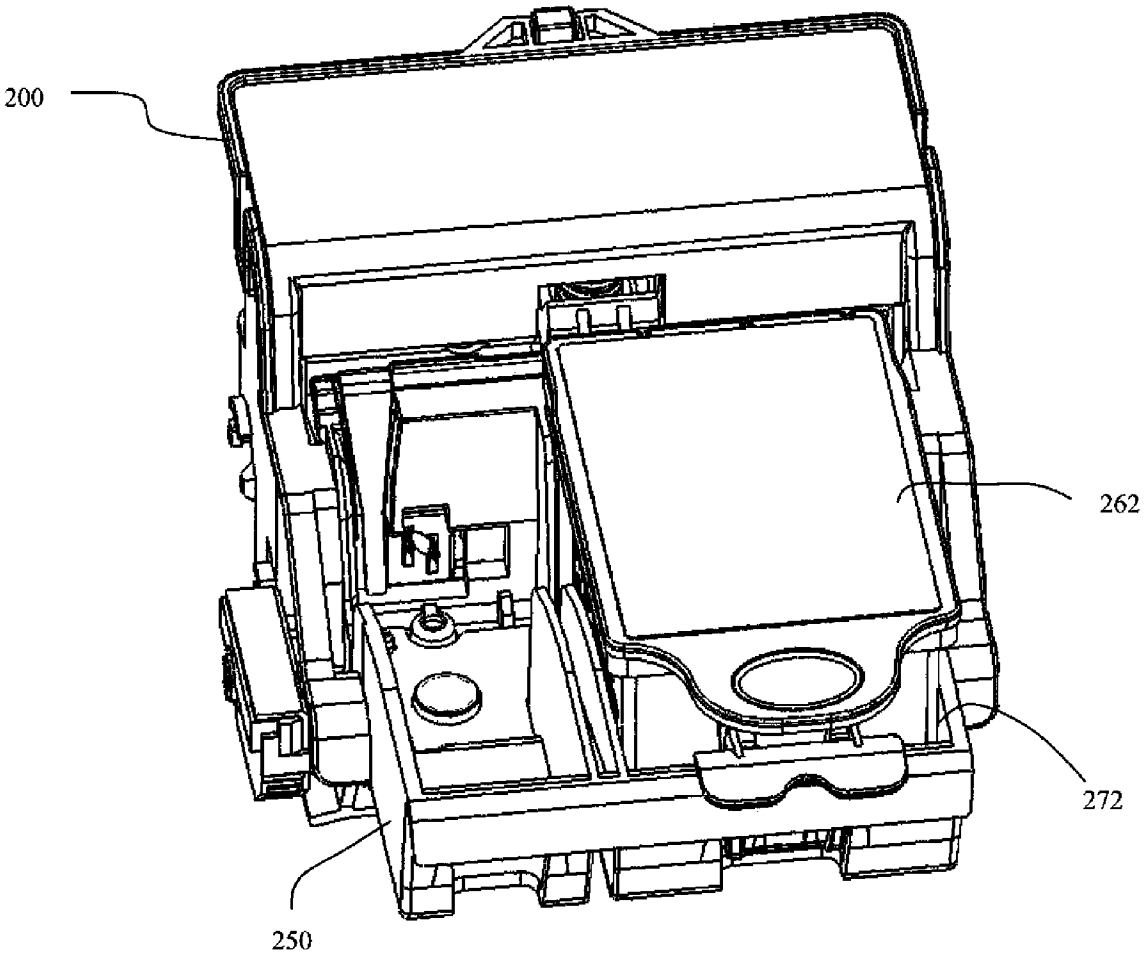
FIG. 7 is a perspective view of an ink tank loaded into the printhead of FIG. 6.
Figure 8:
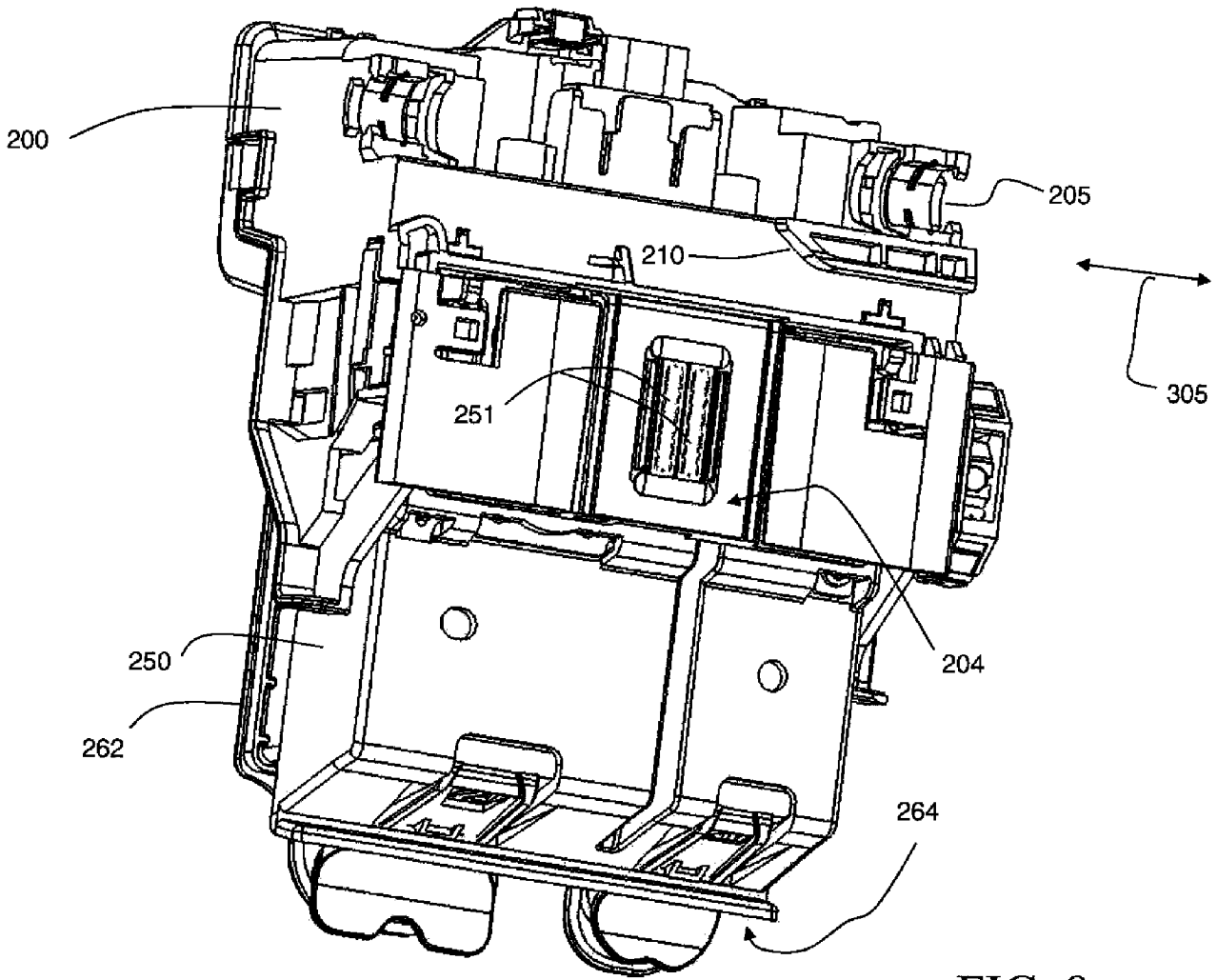
FIG. 8 a perspective view of the carriage, printhead and ink tanks, rotated with respect to FIGS. 5-7.

FIG. 5 is a perspective view of carriage 200. Carriage 200 includes a holder 202 for an inkjet printhead 250 (see FIGS. 3, 6-8). Printhead die 251 are exposed through window 204 of carriage 200 when printhead 250 is mounted onto carriage 200 (FIG. 8). Carriage 200 includes one or more bushings 205 to glide along carriage guide rod 382 (FIG. 4) in carriage scan direction 305. Carriage 200 also includes a connector 244 to mate with connector board 258 of printhead 250 (FIG. 3).

Figure 6:
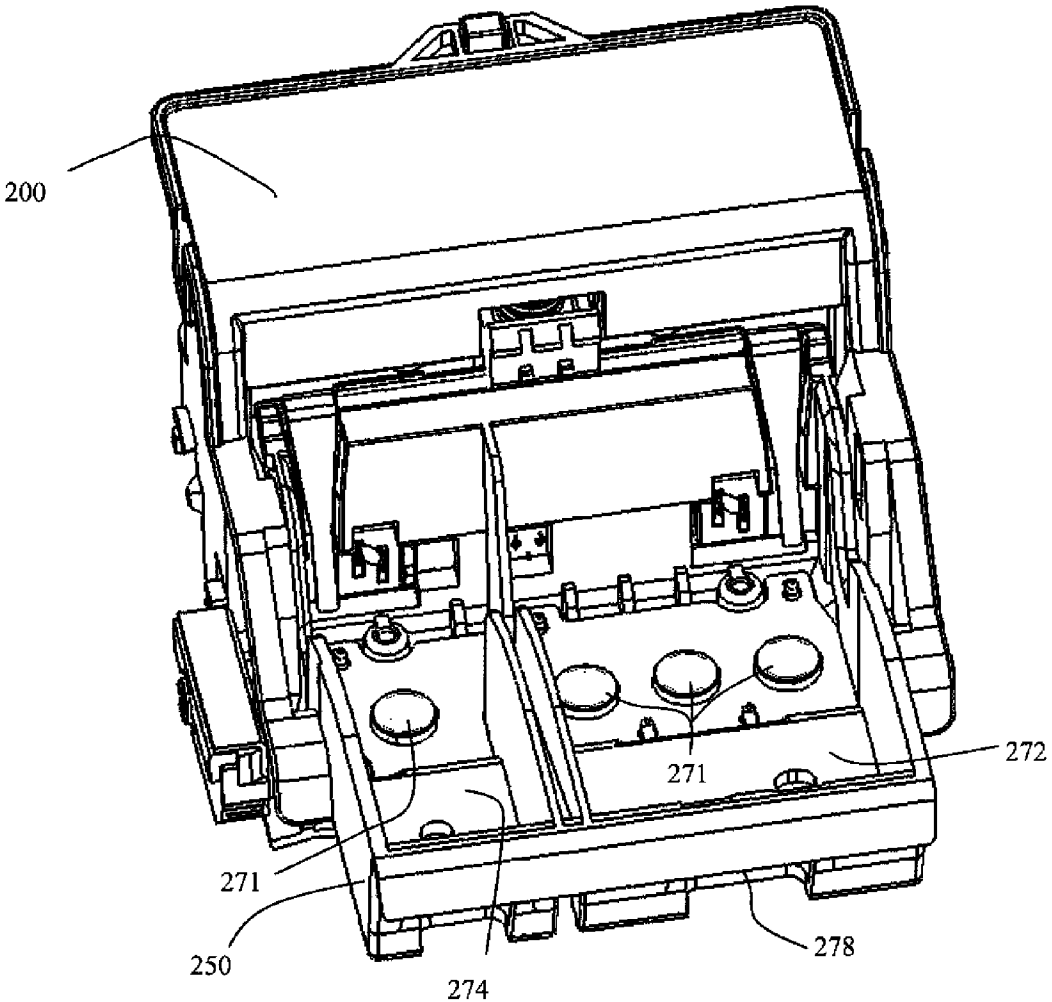
FIG. 6 is a perspective view a printhead mounted onto the carriage of FIG. 5.

FIG. 6 is a perspective view of printhead 250 mounted in carriage 200. Printhead 250 includes compartment 272 for multi-chamber ink supply 262 (FIGS. 3 and 8) and compartment 274 for single chamber ink supply 264. Ink ports 271 receive ink from the ink supplies 262 and 264 and provide the ink to printhead die 251 of printhead 250. FIG. 7 shows a perspective view of multi-chamber ink supply 262 loaded into compartment 272 of printhead 250.

FIG. 8 is a bottom perspective view of the underside of carriage 200 together with printhead 250 and ink supplies 262 and 264. A feature shown in FIG. 8 that is a preferred embodiment of the present invention is sloped feature 210 that is sloped relative to carriage scan direction 305 and that is in line along carriage scan direction 305 with a corresponding ramped feature 412 (described below with reference to FIGS. 9 and 11), such that when sloped feature 210 is engaged with the ramped feature 412, the pivotable pick arm assembly 352 (including pick roller 350) is pivoted in a direction away from media input support 320 (FIG. 4).

Figure 15:
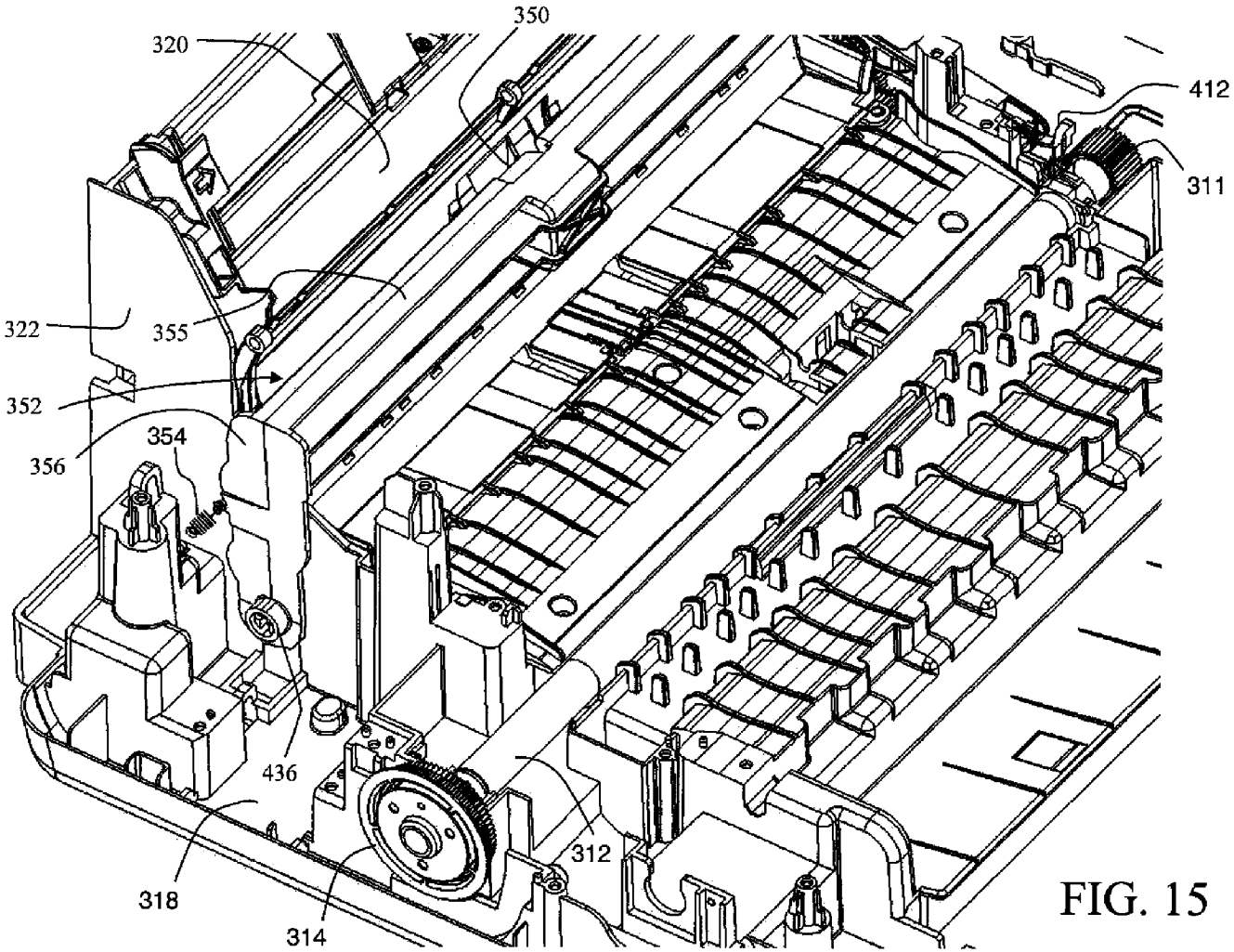
FIG. 15 is a side perspective view from an opposite side relative to FIG. 9.

FIG. 9 is a side perspective view (from right side 306 of FIG. 4) of a portion of an inkjet printing system with the pick arm assembly 352 biased to pivot toward the media input support 320 according to a preferred embodiment of the present invention. Pick arm assembly 352 including pick roller 350, pick roller support arm 355 and support legs 356, is biased toward media input support 320 by biasing spring 354 located near but beyond the first side 321 of media input support 321. Biasing spring 354 is attached to pivotable support leg 356. The biasing support leg 356 near first side 321 has a number of gears mounted on it for transmitting rotational motion to the pick roller 350. A second biasing spring 354 is located near but beyond the second side 322 of media input support 321 as shown in FIG. 15, so that pick roller 350 is disposed between the two biasing springs 354. The biasing support leg 356 near second side 322 does not have gears attached to it (see FIG. 15). Pick roller support arm 355 is substantially parallel to carriage scan direction 305 and extends beyond the first side 321 and the second side 322 of media input support 320 in order to provide attachment points for the two biasing springs 354 at support legs 356 without interfering with the passage of recording medium (not shown). In FIG. 9, carriage 200 is not at its home position near maintenance station 330, so the sloped feature 210 (see FIG. 8) is not engaged with the ramped feature 412 located near maintenance station 330. As a result, biasing springs 354 hold pivotable pick arm assembly 352 so that pick roller 350 is against media input support 320, or against a top piece 371 of media (not shown) at media input support 320. This is the desirable position of the pick roller 350 for moving recording medium from media input support 320. However, if the user attempts to load a few sheets of recording medium having low stiffness while the pick roller 350 is biased against the media input support 320, the recording medium may become wrinkled or damaged while trying to load it.

Figure 10:
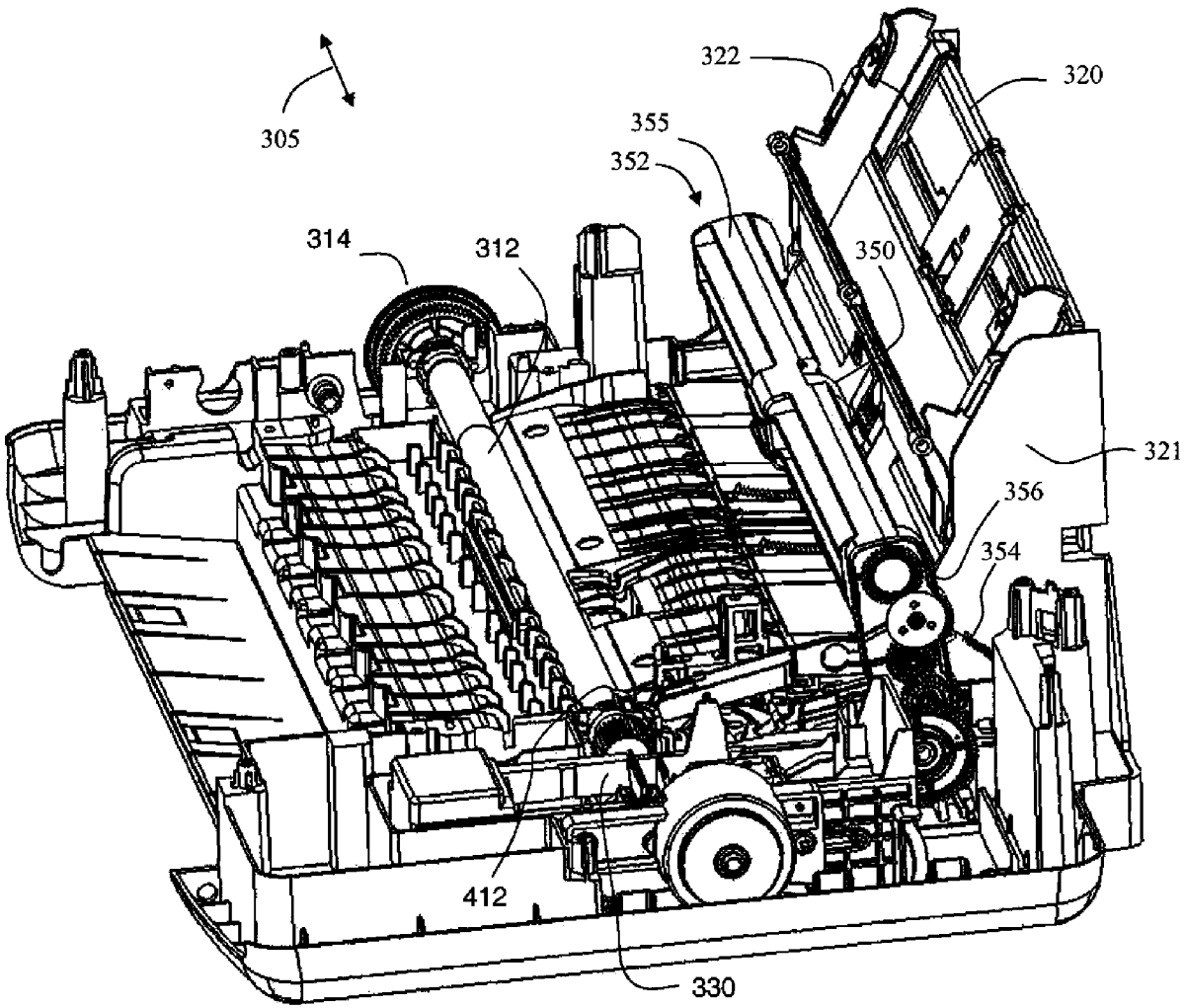
FIG. 10 is a side perspective view of a portion of the inkjet printing system of FIG. 9 with the pick arm assembly pivoted away from the media input support according to a preferred embodiment of the present invention.

Typically a user will load paper between printing jobs when the carriage 200 is at its home position at the maintenance station 330. FIG. 10 is a side perspective view of a portion of the inkjet printing system of FIG. 9 with the pick arm assembly 352 pivoted away from the media input support 320 according to a preferred embodiment of the present invention. The carriage 200 and the carriage guide rail 382 are hidden in the view of FIG. 10 so that the ramped feature 412 can be seen more clearly. The ramped feature 412, having been engaged by the sloped feature 210 on the carriage 200 as the carriage approaches the home position overcomes the biasing force of the biasing springs 354 and pivots the pivot arm assembly 352, including pick roller 350, away from media input support 320, as is described in further detail below. The amount of gap provided between the pick roller 350 and the media input support does not need to be large. It has been found that a gap of more than 2 mm (and up to 6 mm or more) is achievable in this manner. A 6 mm gap can accommodate approximately 60 sheets of media having a thickness of about 100 microns (i.e. about 0.004 inch). Even if the sheets individually have low stiffness, a stack of sheets has sufficient combined stiffness not to become wrinkled or damaged.

Figure 11:
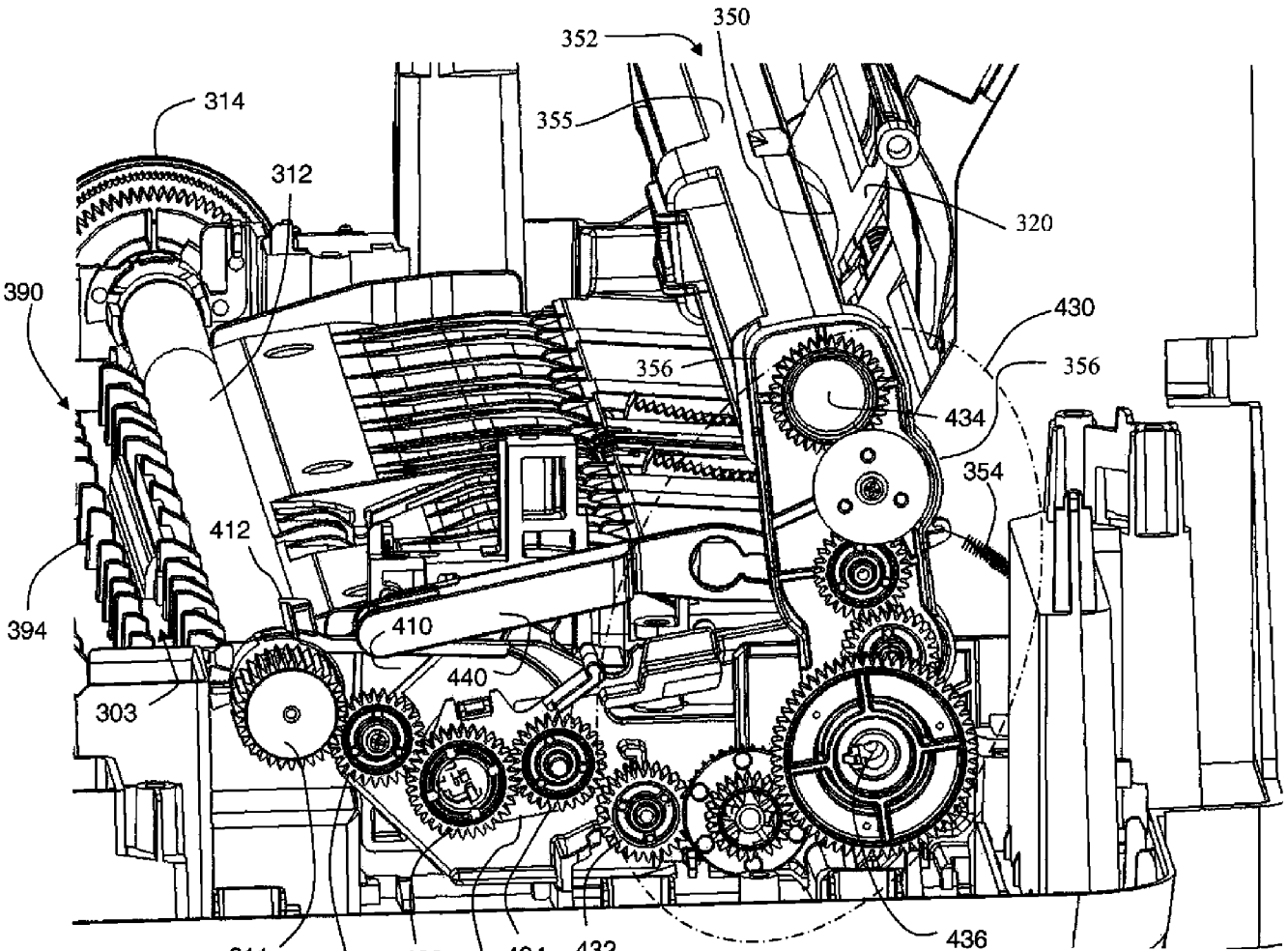
FIG. 11 is a close-up side perspective view similar to FIG. 10 with the pick arm assembly held away from the media input support.

FIG. 11 is a close-up side perspective view similar to FIG. 10 with the pick arm assembly 352 held away from the media input support 320. In FIG. 11, both the carriage and the maintenance station are hidden in order to more clearly show further details, including platen 390 (along print region 303), support ribs 394, pick clutch assembly 420, and gear train 430. In this close-up view it is also easier to see the gap between pick roller 350 and media input support 320 when the carriage is in the home position to pivot the pick arm assembly 352 away from media input support 320. Ramped feature 412 is a part of a rotatable arm 410 that is described in more detail below with reference to FIGS. 16-18. (By a "rotatable" arm herein is meant an arm that can rotate or pivot in an arc about an axis, and does not imply that the arm can rotate in a full circle.) Rotatable arm 410 is linked to pick arm assembly 352 by link arm 440. Power to rotate pick roller 350 is controllably provided by the media advance motor that directly drives feed roller 312 via drive gear 314 mounted on one end of the shaft of feed roller 312. Feed roller gear 311 is coaxially mounted on the opposite end of shaft. Idle gear 316 is always engaged with feed roller gear 311 and with first gear 422 of pick clutch assembly 420. In other words, first gear 422 of pick clutch assembly 420 is located proximate feed roller gear 311, but it is only indirectly engaged with feed roller gear 311 in this preferred embodiment through idle gear 316. Second gear 424 of pick clutch assembly 420 is engaged with first gear 422 and is selectively engageable with engaging gear 432 of gear train 430 (which includes the gears within the dashed line oval in FIG. 11). As described in more detail below, when the sloped feature 210 (FIG. 8) engages ramped feature 412, not only is pick arm assembly 352 pivoted about pivot point 436 on support leg 356, but also second gear 424 of pick clutch assembly 424 is held away from engaging gear 432 of gear train 430, so that no power is transferred to gear train 430. In particular, pick roller gear 434 is not rotated, so no rotational power is provided to pick roller 350.

Figure 12:
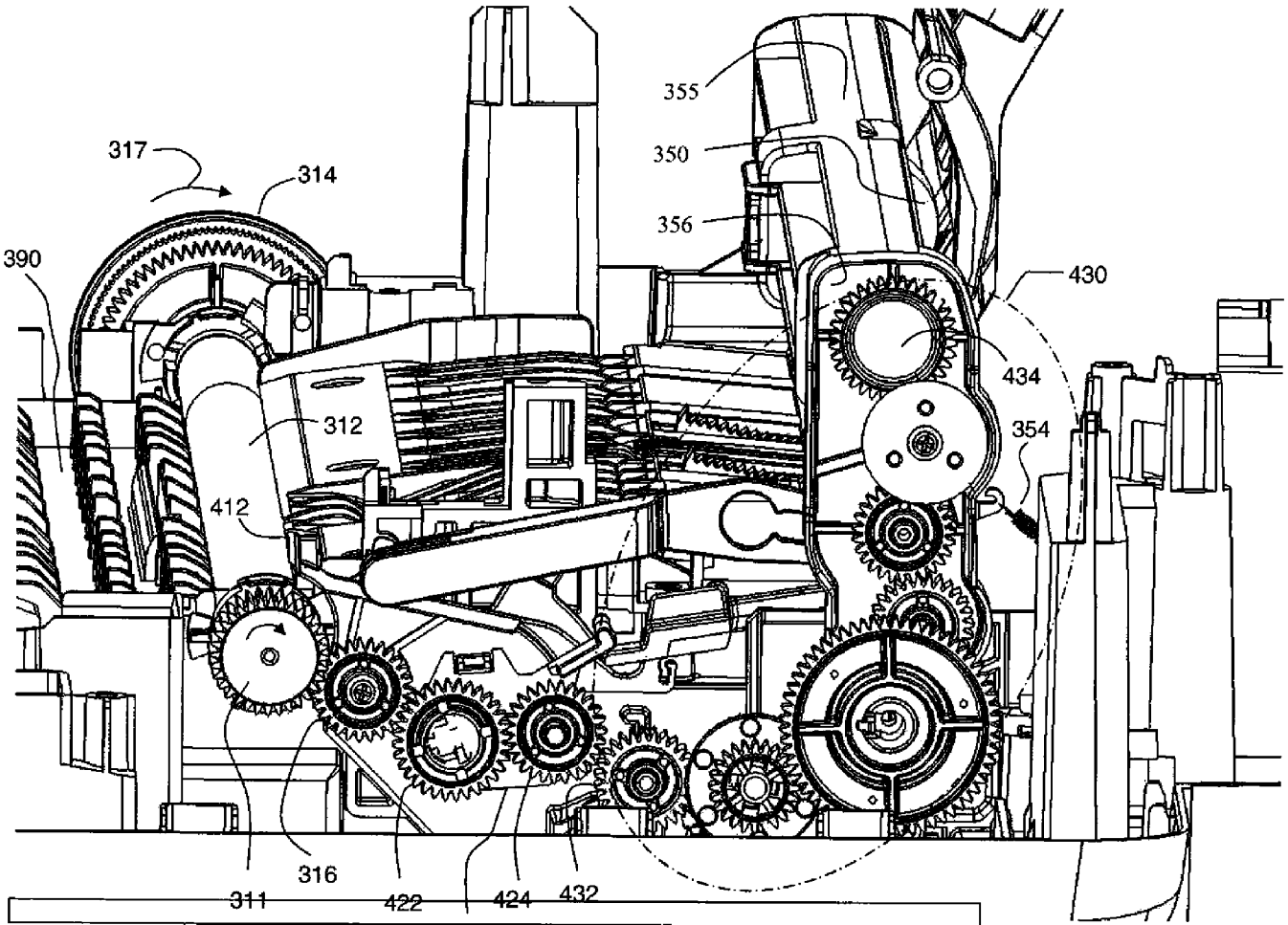
FIG. 12 is a close-up side perspective view with the pick arm assembly biased against the media input support and the pick clutch assembly rotating toward engagement with the gear train.
Figure 13:
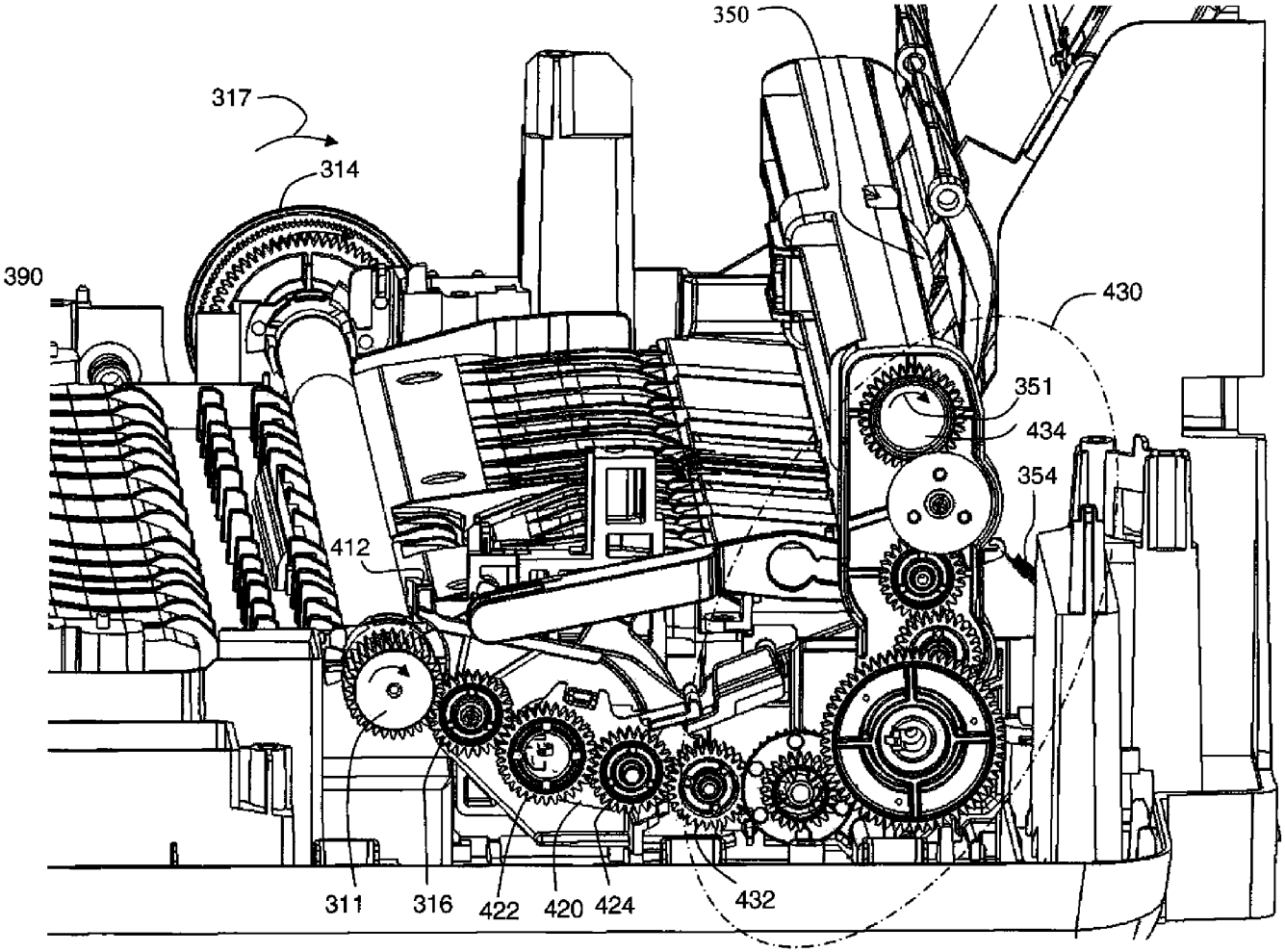
FIG. 13 is a close-up side perspective view with the pick arm assembly biased against the media input support and the pick clutch assembly fully engaged.

FIGS. 12 and 13 are a sequence showing how the second gear 424 of pick clutch assembly 420 becomes engaged with engaging gear 432 of gear train 430 in order to provide rotational power to the pick roller. In both FIGS. 12 and 13 the carriage (not shown) has been moved out of the home position so that ramped feature 412 is no longer engaged by the sloped feature on the underside of the carriage, so that pick arm assembly 352 is biased against the media input support. In FIG. 12 drive gear 314 is being driven in the reverse direction 317, causing both feed roller 312 and feed roller gear 311 also to be driven in the reverse direction (indicated by the arrow on the face of feed roller gear 311). The rotation of feed roller gear 311 in reverse direction cause the idler gear 316 and first gear 422 of pick clutch assembly 420 also to rotate, which causes pick clutch assembly 420 to rotate downward such that second gear 424 of pick clutch assembly 420 approaches engaging gear 432 of gear train 430. In FIG. 12, the second gear 424 of pick clutch assembly 420 is nearly engaged with engaging gear 432 but not quite, so no power is being transmitted to gear train 430. In FIG. 13, after continued reverse rotation of drive gear 314, feed roller 312 and feed roller gear 311, pick clutch assembly 420 has rotated into full engagement so that second gear 424 is engaged with engaging gear 432 of gear train 430. As a result, rotational power is transmitted through gear train 430 causing pick roller gear 434 and pick roller 350 to rotate in rotation direction 351 to move a piece of media (not shown) toward feed roller 312. Note that the direction of arrows 351 for rotation of the pick roller 350 and reverse direction 317 for the feed roller 312 are the same. However, because the pick roller 350 is in contact with the top side of the piece of media, and feed roller 312 is in contact with the bottom side of the piece of media, when the piece of media arrives at feed roller 312, the reversely rotating feed roller 312 tends to push the leading edge of the piece of media backwards. In this way any skew of the leading edge is substantially eliminated.

Figure 14:
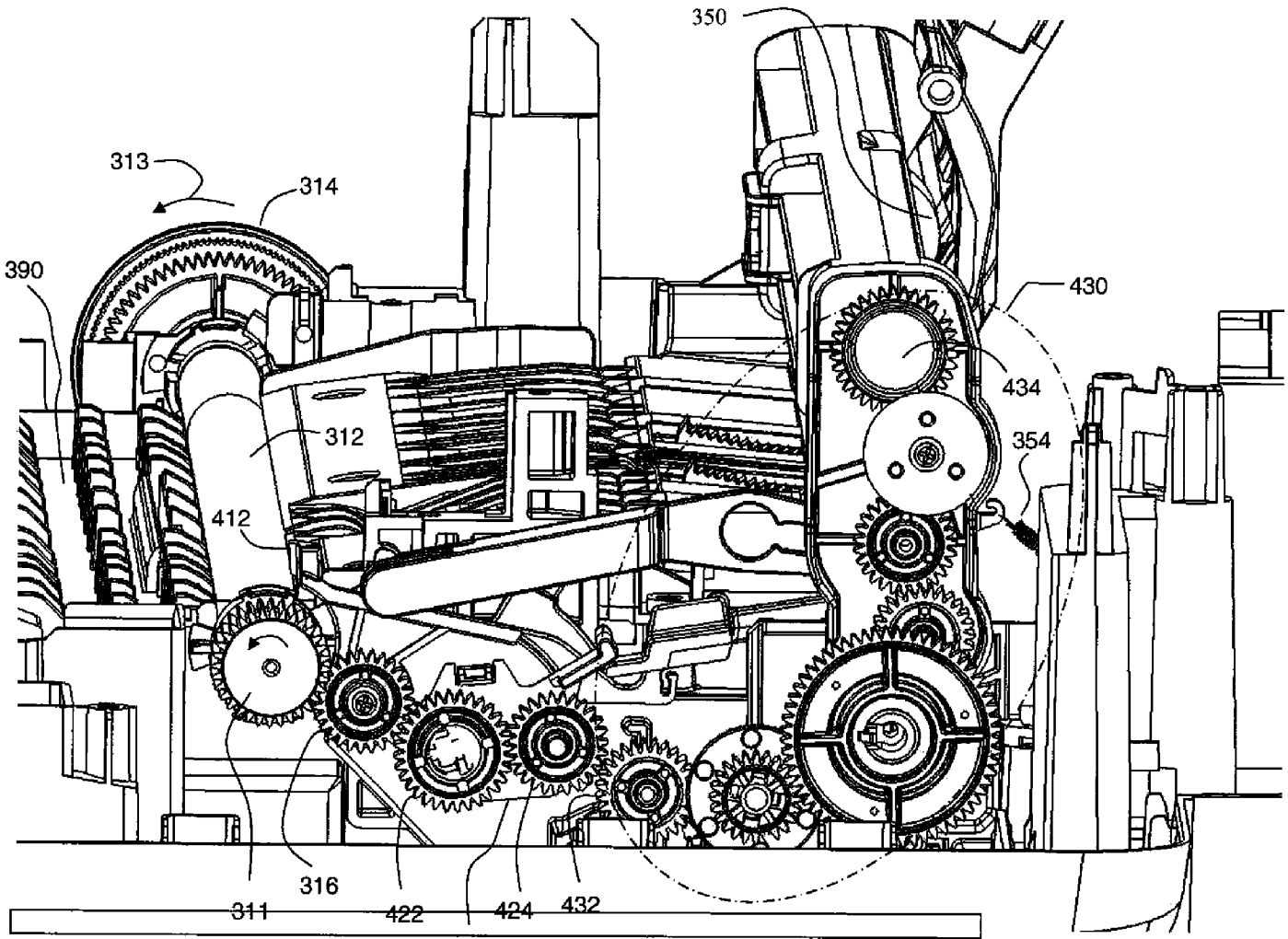
FIG. 14 is a close-up side perspective view with the pick arm assembly biased against the media input support and the pick clutch assembly rotating out of engagement with the gear train.

After the deskewing of the leading edge is completed, the media advance motor is driven in the forward direction to rotate drive gear 314, feed roller 312 and feed roller gear 311 in the forward direction 313. Forwardly rotating feed roller gear 311 causes idle gear 316 and first gear 422 of pick clutch assembly 420 to rotate such that second gear 424 of pick clutch assembly 420 is rotated out of engagement with engaging gear 432 of gear train 430, as shown in FIG. 14. As a result, no rotational power is transmitted through gear train 430, so no rotational power is provided to pick roller 350.

FIG. 15 is a side perspective view (from left side 307 of FIG. 4) of a portion of an inkjet printing system with the pick arm assembly 352 biased to pivot toward the media input support 320 as in FIG. 9. The second biasing spring 354 attached to support leg 356 located near second side 322 of media input support 320 can be seen in this view. In addition, a second pivot point 436 on support leg 356 near second side 322 is shown in this view. Unlike the pivot point 436 near first side 321 seen in FIG. 11 that also serves as an axle for one of the gears of gear train 430, the pivot point 436 seen in FIG. 15 has no associated gears. The media advance motor that powers drive gear 314 is hidden in FIG. 15, but the motor mount region 318 is indicated. The carriage is also hidden in this view.

Figure 16:
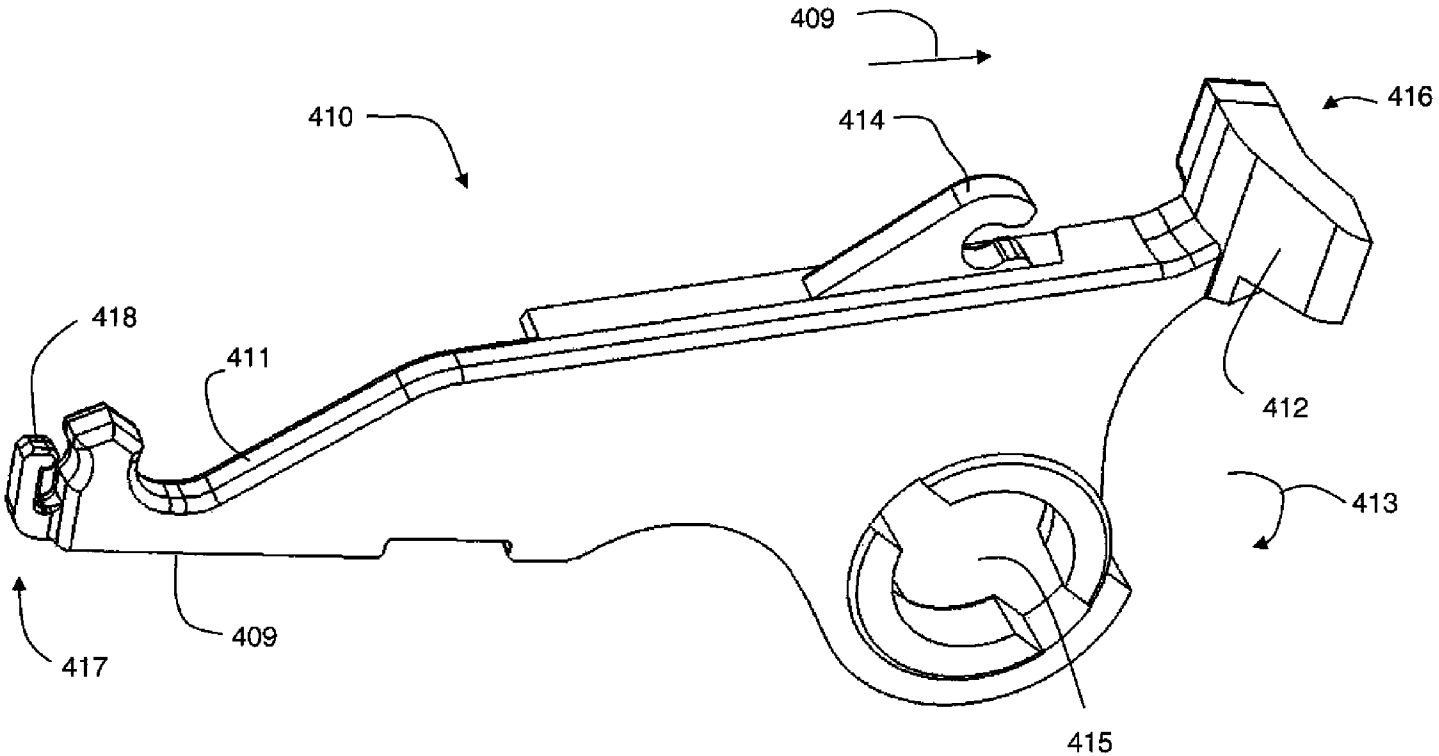
FIG. 16 is a perspective close-up view of a rotatable arm according to a preferred embodiment of the invention.
Figure 17:
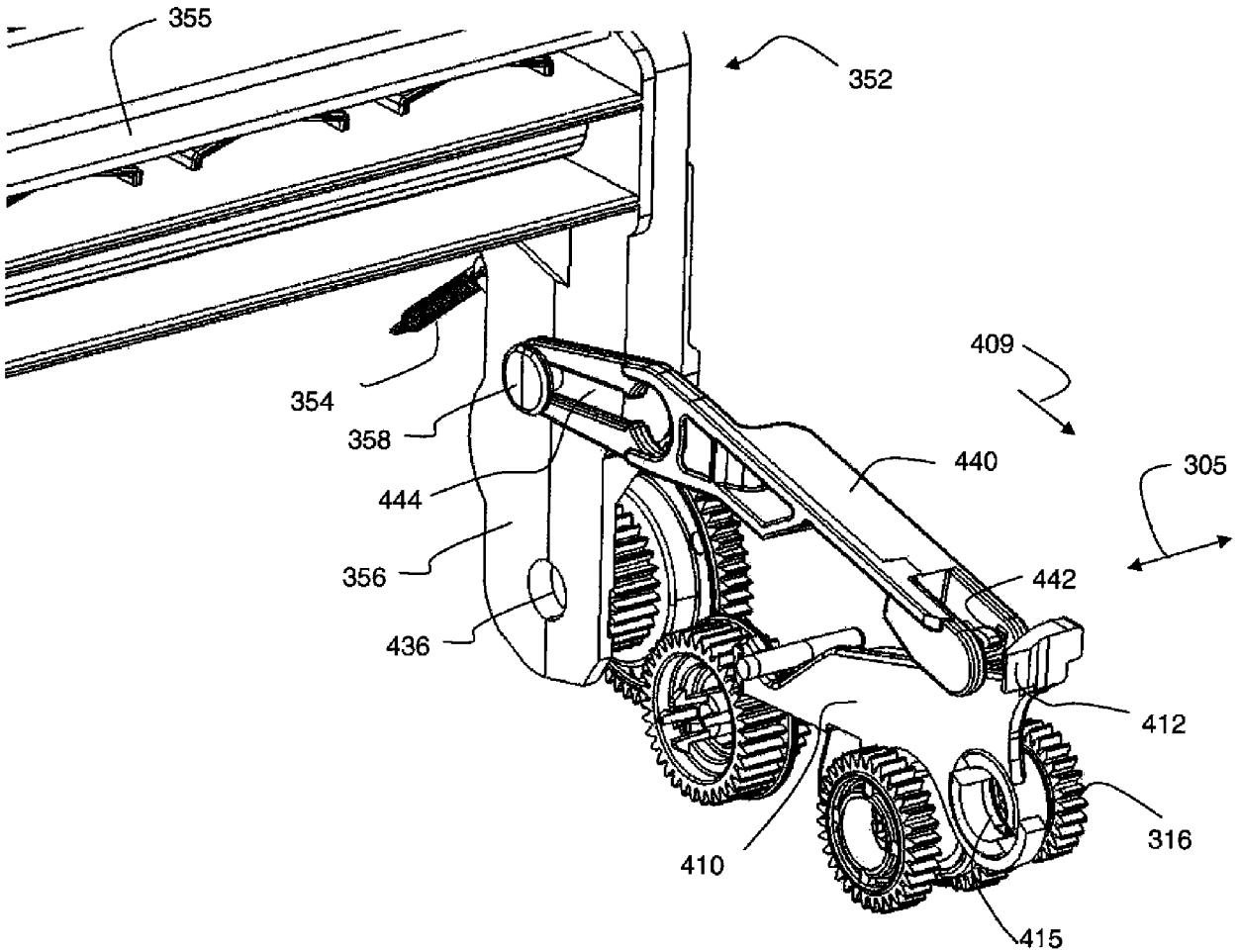
FIG. 17 is a perspective close up view of the rotatable arm, the pivotable pick arm assembly and a link arm that links them.

FIG. 16 is a perspective close-up view of rotatable arm 410 in isolation, as viewed approximately from the orientation of FIG. 15. When ramped feature 412 (located near first end 416) is engaged by sloped feature 210 on the underside of carriage 200 (see FIG. 8), rotatable arm 410 is rotated about hub 415 in rotation direction 413, causing linking hook member 414 to move substantially in direction 409. Linking hook member 414 attaches onto coupling pin 442 of link arm 440, as seen in FIG. 17, so that motion in direction 409 causes link arm 440 to pull on lug 358 on support leg 356, thereby causing support leg 356 of pivotable pick arm assembly 352 to pivot about pivot point 436. Coupling pin 442 is substantially parallel to carriage scan direction 305. Link arm 440 also includes a slot 444. When support leg 356 is being pivoted forward as in FIG. 17 (providing a gap between pick roller 350 and media input support 320 as in FIG. 11) the lug 358 is typically located at the end of the slot 444. A spring attachment member 418 located near second end 417 of rotatable arm 410 (opposite first end 416) is for attaching an extension spring 360 (see FIG. 18) to bias rotatable arm 410 against rotating in rotation direction 413. Thus, when the ramped feature 412 is engaged by sloped feature 210 on the underside of carriage, it needs to pull against both biasing springs 354 as well as extension spring 360.

Figure 18:
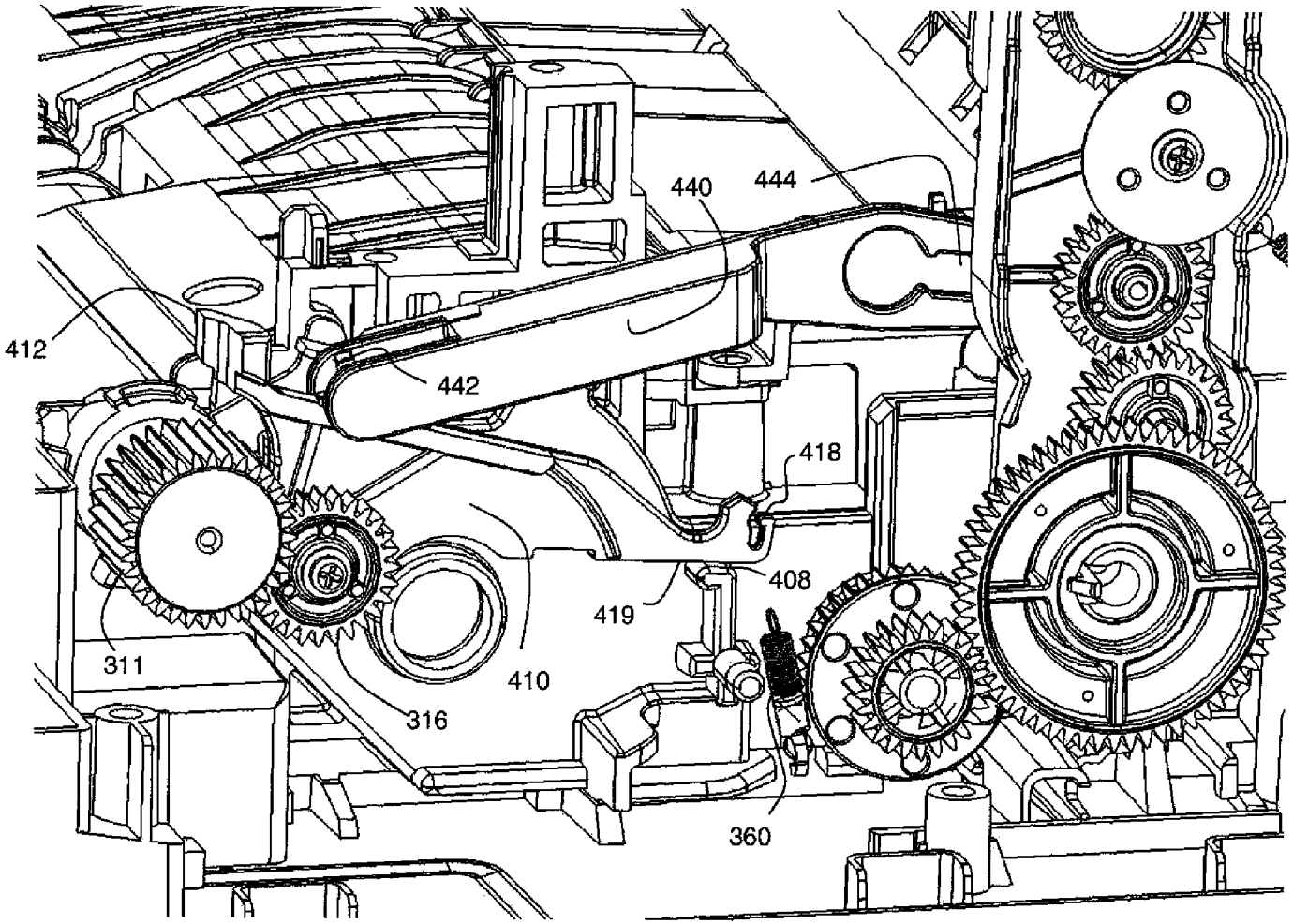
FIG. 18 is a close-up side perspective view of a portion of the views of FIGS. 12 and 13.

FIG. 18 is a close-up side perspective view of a portion of the views of FIGS. 12 and 13 with some features hidden in order to show other features. Extension spring 360 is shown as being detached from spring attachment member 418, but in a fully assembled printer it would be attached. Extension spring 360 is configured to pull rotatable arm 410 toward a predetermined position that is defined by bottom edge 419 being in contact with fixed stop 408. When sloped feature 210 of carriage 200 (see FIG. 8) is engaged with ramped feature 412 of rotatable arm 410, rotatable arm 410 is rotated away from this predetermined position.

Figure 19:
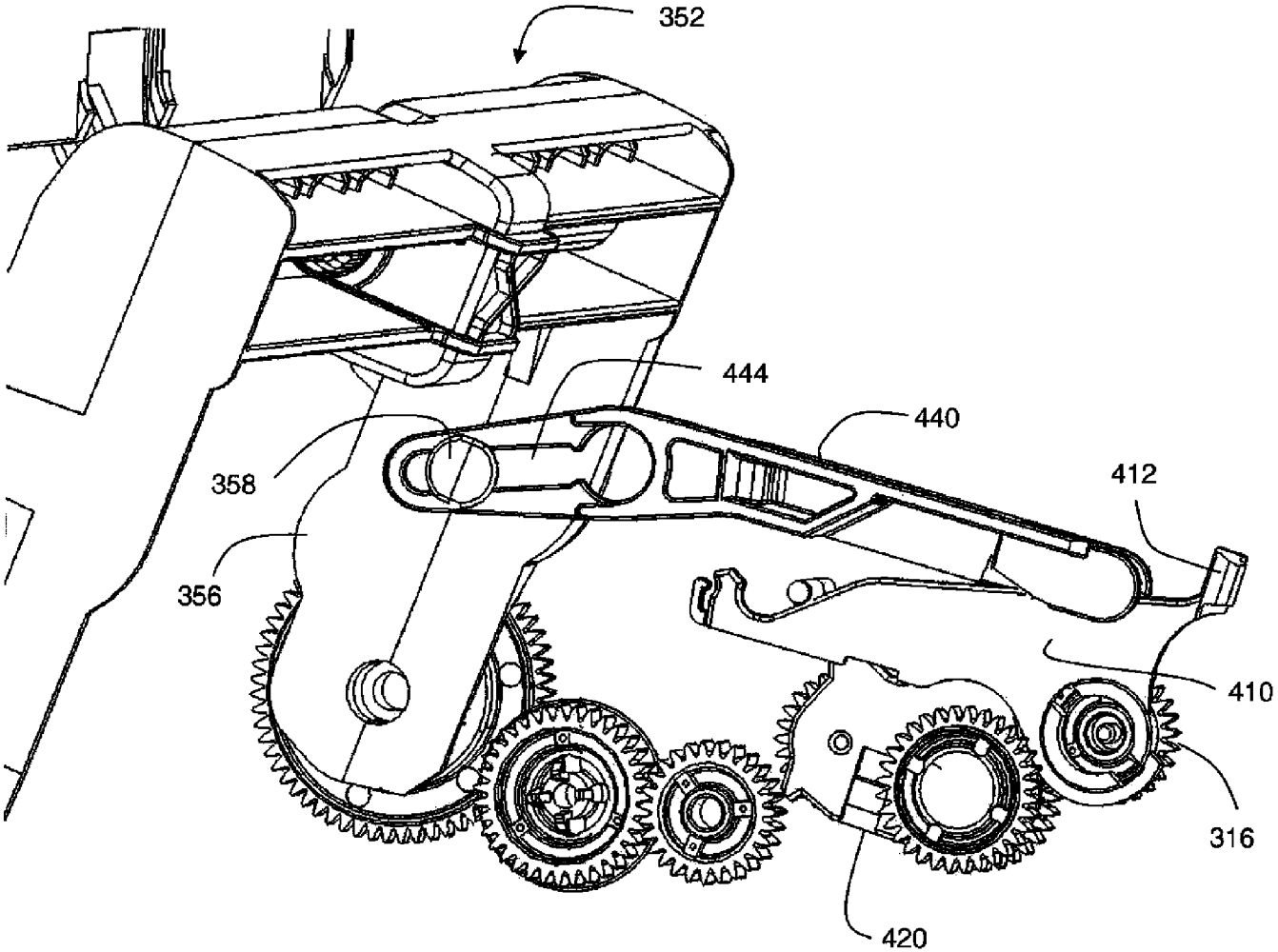
FIG. 19 is a side perspective view where the pick roller is moved farther away from the media input support than the gap provided when the ramp feature is engaged.

As described above relative to FIG. 10, when carriage 200 is in the home position and ramped feature 412 is engaged, pivotable pick arm assembly 352 is pivoted forward to provide a gap of 2 mm up to 6 mm or more between pick roller 350 and media input support 320. However, in many cases a user will want to load a stack of media that has a thickness of greater than the gap provided when the ramp feature 412 is engaged. Slot 444 of link arm 440 allows pivotable pick arm assembly 352 to pivot farther forward so that the pick roller 350 is moved away from media input support 320 by more than one centimeter without causing link arm 440 to push on rotatable arm 410. The side perspective view of FIG. 19 shows lug 358 of support leg 356 having moved along slot 444 in order to allow pick roller 350 to be moved farther away from media input support 320 than the gap provided when ramp feature 412 is engaged. FIGS. 17 and 19 also show that idle gear 316 is mounted at hub 415 of rotatable arm 410.

Figure 20:
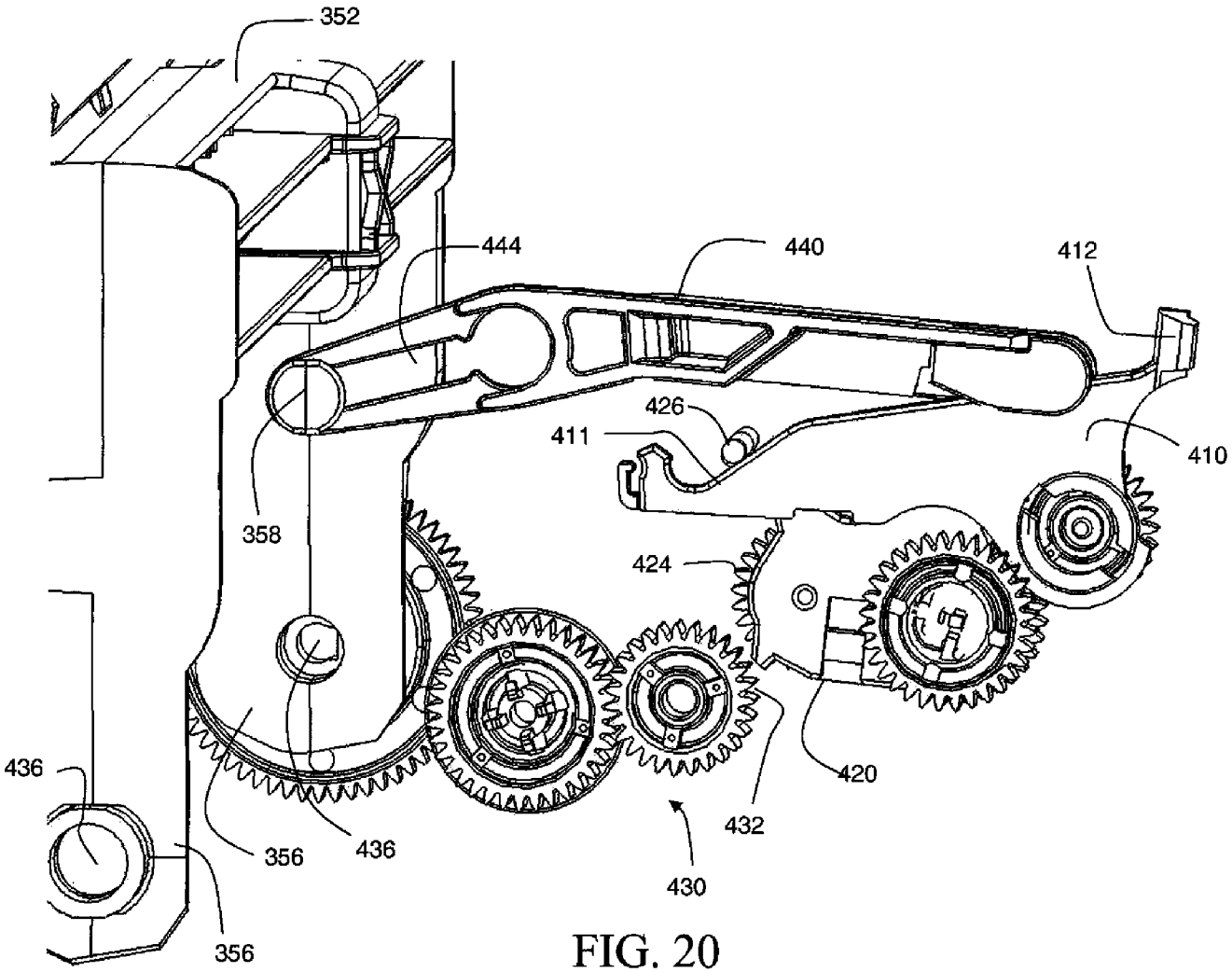
FIG. 20 is a close-up side perspective view of rotatable arm, pick clutch assembly, link arm and pivotable pick arm assembly.

FIG. 20 is a close-up side perspective view of rotatable arm 410, pick clutch assembly 420, link arm 440 and pivotable pick arm assembly 352 in a configuration such that ramped feature 412 is engaged with sloped feature 210 of carriage 200 (see FIG. 8), and lug 358 is at the rear of slot 444. In this configuration a top edge 411 (see also FIG. 16) of rotatable arm 410 pulls on finger 426 of pick clutch assembly 420 so that second gear 424 is pulled out of engagement with engaging gear 432 of gear train 430. As a result, pick roller 350 is not rotated whether the feed roller 312 is rotated in the forward direction 313 or the reverse direction 317 (see FIGS. 13 and 14).

Figure 21:
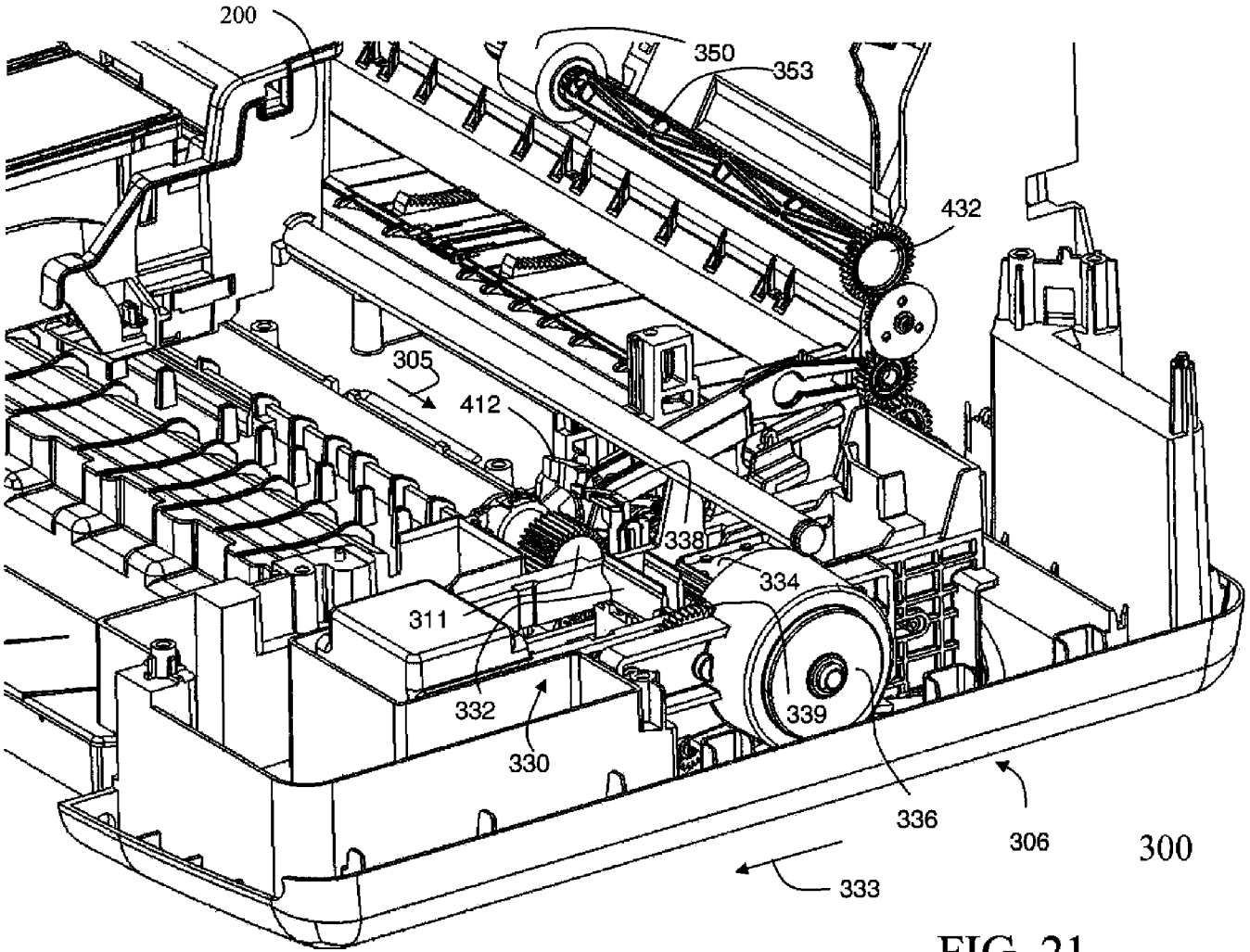
FIG. 21 is a side perspective view of a portion of an inkjet printing system including a maintenance station, according to a preferred embodiment of the invention.

FIG. 21 is a perspective view of the right side 306 of printer chassis 300. Maintenance station 330 is similar to the maintenance station described in US Patent Application Publication 2009/0174748, which is incorporated by reference herein in its entirety. Activator arm 338 is analogous to the latching clutch arm of '748 and has a ramped surface similar to ramped feature 412. In particular, in the present invention when carriage 200 moves all the way to its home position at maintenance station 330, sloped feature 210 on the underside of carriage 200 (see FIG. 8), not only engages ramped feature 412, but also activator arm 338. When activator arm 338 is engaged, power from the media advance motor is transmitted from feed roller gear 311 to a set of maintenance station gears (only one of which 339 is shown). As described relative to FIG. 20, when ramped feature 412 is engaged with sloped feature 210, no power is transmitted to pick roller 350, so there is no additional load on the media advance motor when it is powering the maintenance station 330. When the activator arm 338 is engaged and the media advance motor is rotated in a reverse direction to rotate the feed roller gear 311 in a reverse direction 317 (see FIG. 13), the wiper 332 is moved along direction 333 to wipe the printhead that is positioned over the maintenance station 330. Further reverse rotation of feed roller gear 311 causes cap 334 to move into a printhead capping position to prepare the printer for a period of non-printing. Pump 336 can optionally be operated by further reverse rotation. When it is time to begin another print job, the media advance motor is rotated in a forward direction to rotate feed roller gear 311 in a forward direction 313 (see FIG. 14) and the cap 334 is moved out of the printhead capping position. Continued forward rotation of the media advance motor then causes wiper 332 to move in a direction that is opposite direction 333 in order to wipe the printhead. Pump 336 can optionally be operated by further forward rotation.

In FIG. 21 the housing of pick roller assembly 352 has been hidden in order to show pick roller drive shaft 353 and how it connects pick roller 350 with pick roller drive gear 432. Also, as seen in FIG. 21, both the ramped feature 412 of rotatable arm 410 and the activator arm 338 are located near maintenance station 330 so that they can both be engaged when the carriage 200 enters its home position at the maintenance station. Furthermore, in this preferred embodiment, activator arm 338 is between rotatable arm 410 and maintenance station 330.

Having described the features of the apparatus it is now possible to describe the method of operation. Controller 14 (see FIG. 2) of the printer is programmed to operate the various functions of the printer, including the functions of the motor that moves the carriage, and the motor that advances the media. When the carriage 200 is out of its home position at the maintenance station 330 so that sloped feature 210 is not engaged with ramped feature 412 of rotatable arm 410, the pick arm assembly 352 is biased toward the media input support 321. When the carriage 200 is moved to a position such that sloped feature 210 engages with ramped feature 412, rotatable arm 410 pulls the pivotable pick arm assembly 352 in a direction away from the media input support 320, thereby providing a gap between pick roller 350 and media input support 320. In addition, when the ramped feature 412 is engaged, it causes the pick clutch assembly 420 to disengage from gear train 430, so that no rotational power is provided to the pick roller 350. At this point paper or other recording media can be easily loaded without wrinkling or other damage. When the carriage 200 is moved along carriage scan direction 305 until the sloped feature 210 is disengaged from ramp feature 412, the biasing force on the pivotable pick arm assembly 352 causes it to move in a direction toward the media input support 320.

While the carriage 200 is out of its home position so that the ramped feature 412 is disengaged, paper or other recording media can be moved out of the media input support 320 by rotating the media advance motor in a reverse direction 317 to rotate the feed roller and feed roller gear in a reverse direction. This causes pick clutch assembly 420 to engage with gear train 430 to provide power to the pick roller and rotate it in a rotation direction 351 to advance a piece of media from the media input support 320 toward the feed roller 312. A lead edge of the paper can be detected by a mechanical flag, an optical sensor, or other such sensor (not shown). A suitable amount of time is provided for the feed roller 312 to rotate in the reverse direction 317 to oppose the passage of the lead edge in order to straighten out the paper if it is skewed. Then the controller 14 instructs the media advance motor to rotate in the forward direction. This moves the piece of paper toward the print region 303 so that an image can be printed on it. The motion in the forward direction 313 of the feed roller causes the pick clutch assembly 420 to disengage from gear train 430 so that rotational power is no longer provided to pick roller 350. Thus the pick roller 350 does not tend to move the next piece of paper out of media input support 320 until the controller 14 later instructs the media advance motor to rotate in reverse again, after the previous page is discharged from the printer.

When the carriage moves into its home position for maintenance operations, not only does the engaged ramped feature 412 cause the pick arm assembly 352 to move away from media input support 320 and stop transmission of rotational power to the pick roller 350, in addition the engagement of the activator arm 338 enables transmission of power from the media advance motor through the feed roller gear 311 to power the various maintenance station operations such as wiping, capping, and pumping. In some printers the wiper blades are substantially perpendicular to the carriage scan direction 305 and are positioned at the end of travel of the carriage, so that the nozzle face is wiped in a direction from nozzle array 251 to nozzle array 253. This can cause cross-contamination of the nozzle arrays 253 due to the different inks in the different nozzle arrays. In the preferred embodiment shown in FIG. 21, the wiper 332 is substantially parallel to carriage scan direction 305. In order for wiper 332 to wipe the printhead face, the wiper must be mechanically moved past the printhead along direction 333, which is substantially parallel to nozzle array direction 254 (see FIG. 3). Wiping along the nozzle array direction 254 is significantly less prone to cross-contamination of nozzle arrays 253. After the carriage 200 is moved into maintenance station 330 and activator arm 338 is engaged, the controller 14 instructs the media advance motor to rotate in reverse direction. This first causes wiper 332 to move along direction 333 to wipe the printhead face. Further reverse rotation causes the cap 334 to move into a printhead capping position so that volatile components are less likely to evaporate from the ink at the printhead nozzle face. Further reverse rotation can cause the pump 336 to apply suction to the cap in order to withdraw some ink from the nozzles for cleaning or priming.

When it is time for the next printing job, the controller 14 instructs the media advance motor to rotate in a forward direction. This moves the cap 334 out of its capping position. Further forward rotation of the media advance motor causes the wiper to wipe the printhead nozzle face by moving in a direction opposite to direction 333. Further forward rotation can cause the pump 336 to apply suction to the cap to remove waste ink from the cap. The controller 14 then instructs the carriage to move out of the maintenance station 330 so that power is disengaged from the maintenance station. The biasing force on the pivotable pick arm assembly 352 pulls the pick roller 350 into contact with top piece of media in the media input support 320. The controller 14 instructs the media advance motor to rotate in reverse so that power is transmitted to the pick roller 350 and a piece of paper is moved forward for the next print job.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
202 Holder
204 Window
205 Bushing
210 Sloped feature
244 Connector
250 Printhead
251 Printhead die
253 Nozzle array
254 Nozzle array direction
255 Mounting support member
256 Encapsulant
257 Flex circuit
258 Connector board
262 Multi-chamber ink supply
264 Single-chamber ink supply
270 Ink drops
271 Ink port
272 Compartment
274 Compartment
300 Printer chassis
301 Paper load entry direction
302 Base
303 Print region
304 Media advance direction
305 Carriage scan direction
306 Right side of printer chassis
307 Left side of printer chassis
309 Rear of printer chassis
311 Feed roller gear
312 Feed roller
313 Forward rotation direction (of feed roller)
314 Drive gear
316 Idle gear
317 Reverse rotation direction (of feed roller)
318 Motor mount region
320 Media input support
321 First side
322 Second side
323 Idler roller
324 Discharge roller
325 Star wheel(s)
330 Maintenance station
332 Wiper
333 Direction
334 Cap
336 Pump
338 Activator arm (for maintenance station)
339 Maintenance station gear
340 Media retention plate
350 Pick roller
351 Rotation direction
352 Pick arm assembly
353 Pick roller drive shaft
354 Biasing spring
355 Support arm
356 Support leg
358 Lug
360 Extension spring
370 Stack of media
371 First piece of medium
382 Carriage guide rail
390 Platen
392 Absorbent material
394 Support ribs
408 Fixed stop
409 Direction
410 Rotatable arm
411 Top edge
412 Ramped feature
413 Rotation direction
414 Linking hook member
415 Hub
416 First end
417 Second end
418 Spring attachment member
419 Bottom edge
420 Pick clutch assembly
422 First gear (of pick clutch assembly)
424 Second gear (of pick clutch assembly)
426 Finger
430 Gear train
432 Engaging gear (of gear train)
434 Pick roller drive gear
436 Pivot point
440 Link arm
442 Coupling pin

The invention claimed is:

1. A method of operating a media feeder in an inkjet printing system, the method comprising:

providing a media input support;

providing a pivotable pick arm assembly including a pick roller that is biased to pivot toward the media input support;

providing a rotatable arm including:

a member that is linked to the pivotable pick arm assembly; and a ramped feature;

providing a carriage that is movable along a carriage scan direction, the carriage including:

a holder for an inkjet printhead; and a sloped feature that is in line with the ramped feature of the rotatable arm; and moving the carriage along the carriage scan direction until the sloped feature of the carriage engages the ramped feature of the rotatable arm, thereby rotating the rotatable arm to pull the pivotable pick arm assembly in a direction away from the media input support.

2. The method according to claim 1, wherein the step of rotating the rotatable arm to pull the pivotable pick arm assembly in a direction away from the media input support further comprises providing a gap between the pick roller and the media input support.

3. The method according to claim 2 further comprising the step of loading paper at the media input support after the gap is provided.

4. The method according to claim 1 further comprising the step of biasing the pick arm assembly to move toward the media input support when the sloped feature of the carriage is not engaged with the ramped feature of the rotatable arm.

5. The method according to claim 1 further comprising:
providing a media advance motor;
providing a feed roller;
providing a feed roller gear that is coaxially mounted on the feed roller;
providing a pick clutch assembly including:
a first gear disposed proximate the feed roller gear; and
a second gear engaged with the first gear;
providing a gear train for transmitting power to rotate the pick roller; and
moving the carriage along the carriage scan direction until the sloped feature of the carriage is disengaged from the ramped feature of the rotatable arm, thereby allowing the pivotable pick arm assembly to move in a direction toward the media input support.

6. The method according to claim 5 further comprising:
rotating the media advance motor in a reverse direction to rotate the feed roller and feed roller gear in a reverse direction;
engaging the pick clutch assembly with the gear train to provide power to the pick roller; and
rotating the pick roller in a direction to advance a piece of media from the media input support toward the feed roller.

7. The method according to claim 6 further comprising:
detecting a lead edge of the piece of media;
rotating the media advance motor in a forward direction after the lead edge of the piece of media is detected to have reached the feed roller; and
disengaging the pick clutch assembly from the gear train.

8. The method according to claim 1 further comprising the step of disengaging the pick clutch assembly from the gear train when the sloped feature of the carriage engages the ramped feature of the rotatable arm.

9. A method of operating an inkjet printing system, the method comprising:
providing a media input support;
providing a pivotable pick arm assembly including a pick roller that is biased to pivot toward the media input support;
providing a rotatable arm including:
a member that is linked to the pivotable pick arm assembly; and
a ramped feature;
providing a carriage that is movable along a carriage scan direction, the carriage including:
an inkjet printhead; and
a sloped feature that is in line along the carriage scan direction with the ramped feature of the rotatable arm;
providing a maintenance station proximate the rotatable arm, the maintenance station including a cap and a maintenance station activator arm;
providing a media advance motor;
providing a feed roller;
providing a feed roller gear that is coaxially mounted on the feed roller;
providing a pick clutch assembly including:
a first gear disposed proximate the feed roller gear; and
a second gear engaged with the first gear;
providing a gear train for transmitting power to rotate the pick roller
moving the carriage along the carriage scan direction until the sloped feature of the carriage engages the ramped feature of the rotatable arm, thereby disengaging the pick clutch assembly;
further moving the carriage along the carriage scan direction until the printhead is over the maintenance station and the sloped feature of the carriage engages the maintenance station activator arm; and
rotating the media advance motor in reverse to move the cap into a printhead capping position.

10. The method according to claim 9, the maintenance station further comprising a wiper, wherein the step of rotating the media advance motor in reverse moves the wiper to wipe the printhead before the cap is moved into the printhead capping position.

11. The method according to claim 9 further comprising the step of rotating the media advance motor forward to move the cap out of the printhead capping position.

12. The method according to claim 10 further comprising the step of rotating the media advance motor forward to move the cap out of the printhead capping position and then move the wiper to wipe the printhead.

13. A method of automatically pivoting a pick arm assembly away from a media support in a printer, comprising the steps of:
providing a print head carriage including a sloped feature, wherein the print head carriage travels along a carriage scan path;
providing a linking assembly coupled to the pick arm assembly wherein the linking assembly includes a ramped feature; and
pivoting the pick arm assembly away from the media support in the printer including the sloped feature engaging the ramped feature when the printhead carriage travels along the carriage scan path.

14. The method of claim 13, wherein said step of the sloped feature engaging the ramped feature occurs when the printhead carriage is approaching one end of the carriage scan path.

15. The method of claim 13, wherein said step of the sloped feature engaging the ramped feature includes the sloped feature causing the ramped feature to move away from the media support in the printer and the linking assembly causing the pick arm assembly to pivot away from the media support in the printer.

16. The method of claim 13, wherein said linking assembly includes a rotatable arm coupled to a link arm, and wherein the pick arm assembly includes a lug for coupling to the link arm.

17. The method of claim 16, wherein said rotatable arm includes said ramped feature for engaging the sloped feature.

* * * * *